US010733867B2

(12) United States Patent
Ishikawa

(10) Patent No.: US 10,733,867 B2
(45) Date of Patent: Aug. 4, 2020

(54) SERVER AND NON-TRANSITORY RECORDING MEDIUM STORING PROGRAM

(71) Applicant: Paramount Bed Co., Ltd., Koto-ku, Tokyo (JP)

(72) Inventor: Takashi Ishikawa, Tokyo (JP)

(73) Assignee: PARAMOUNT BED CO., LTD., Tokyo (JP)

( * ) Notice: Subject to any disclaimer, the term of this patent is extended or adjusted under 35 U.S.C. 154(b) by 0 days.

(21) Appl. No.: 16/749,327

(22) Filed: Jan. 22, 2020

(65) Prior Publication Data

US 2020/0160687 A1 May 21, 2020

Related U.S. Application Data

(63) Continuation of application No. 16/177,700, filed on Nov. 1, 2018, now Pat. No. 10,586,438.

(30) Foreign Application Priority Data

Nov. 29, 2017 (JP) ..... 2017-229290

(51) Int. Cl.

| | |
|---|---|
| ***G08B 23/00*** | (2006.01) |
| ***G08B 21/04*** | (2006.01) |
| ***G08B 21/18*** | (2006.01) |
| ***G08B 21/06*** | (2006.01) |

(52) U.S. Cl.

CPC ..... *G08B 21/0469* (2013.01); *G08B 21/043* (2013.01); *G08B 21/0415* (2013.01); *G08B 21/06* (2013.01); *G08B 21/182* (2013.01)

(58) Field of Classification Search

CPC ..... G08B 21/0469; G08B 21/0415; G08B 21/043; G08B 21/06; G08B 21/182

USPC ..... 340/575

See application file for complete search history.

(56) References Cited

U.S. PATENT DOCUMENTS

| | | | | |
|---|---|---|---|---|
| 9,517,034 | B2 | 12/2016 | Collins, Jr. et al. | |
| 2011/0190594 | A1* | 8/2011 | Heit | A61M 21/00 600/301 |
| 2012/0025992 | A1* | 2/2012 | Tallent | G08B 21/22 340/573.4 |
| 2014/0022080 | A1* | 1/2014 | Mayoras, Jr. | G08B 21/0453 340/573.1 |
| 2015/0199892 | A1* | 7/2015 | Johnson | G08B 21/0476 348/77 |
| 2017/0245808 | A1* | 8/2017 | Jain | A61B 5/7282 |

(Continued)

FOREIGN PATENT DOCUMENTS

| | | |
|---|---|---|
| JP | 2002-327624 A | 11/2002 |
| JP | 2002-327632 A | 11/2002 |

(Continued)

*Primary Examiner* — Naomi J Small

(74) *Attorney, Agent, or Firm* — Harness, Dickey & Pierce, P.L.C.

(57) ABSTRACT

A management system includes, a sensor configured to detect biological information on a user, a communication unit capable of communicating with a terminal device and capable of receiving the biological information, a controller configured to detect whether the user is awake or gets out of the bed, based on the received biological information and activate an alarm to the terminal device, and a display configured to prioritize the alarm related to the user which has a high possibility of falling off the bed.

15 Claims, 17 Drawing Sheets

(56) References Cited

U.S. PATENT DOCUMENTS

| | | | | |
|---|---|---|---|---|
| 2017/0287316 | A1* | 10/2017 | Wildman | G08B 25/10 |
| 2017/0365148 | A1* | 12/2017 | Rosenfeld | A61B 5/0205 |

FOREIGN PATENT DOCUMENTS

| | | | |
|---|---|---|---|
| JP | 2002-327633 | A | 11/2002 |
| JP | 2008-206869 | A | 9/2008 |
| JP | 2009-118980 | A | 6/2009 |

* cited by examiner

FIG. 3

| Patient ID | Priority For Determination | Priority Determining Threshold | |
|---|---|---|---|
| | | Bed Height | ··· |
| K001 | High | 40cm | ··· |
| K002 | Low | 50cm | ··· |
| ⋮ | ⋮ | ⋮ | ⋮ |

FIG. 4

| Threshold Name | Value |
|---|---|
| Bed-Exit Determining Threshold | 4 |
| Priority Threshold | 2 |
| Bed Height Threshold | 40cm |

FIG. 5

| Priority | Setting Items |
|---|---|
| High | Awake = ON, Bed Exit = ON, Bed Height = ON, ··· |
| Medium | Awake = Off, Bed Exit = ON, Bed Height = ON, ··· |
| Low | Awake = OFF, Bed Exit = OFF, Bed Height = OFF, ··· |

SERVER AND NON-TRANSITORY RECORDING MEDIUM STORING PROGRAM

CROSS-REFERENCE TO RELATED APPLICATIONS

This nonprovisional application is a continuation application of and claims priority under 35 U.S.C. § 120/121 to U.S. application Ser. No. 16/177,700 filed Nov. 1, 2018, which claims priority under 35 U.S.C. 119 (a) on Patent Application No. 2017-229290 filed in Japan on 29 Nov. 2017, the entire contents of each of which are hereby incorporated by reference herein.

FIELD

The present embodiment relates to a server and a non-transitory recording medium storing a program.

BACKGROUND

As a conventional technology, there has been known and disclosed a system, which is connected to various devices including a bed via a network to obtain the state of the bed and the state of a patient from the devices. There has been disclosed the technology such that when the obtained states match a predetermined warning condition, an alarm is given to a mobile terminal communication device possessed by a care giver (e.g., refer to U.S. Pat. No. 9,517,034).

BRIEF DESCRIPTION OF THE DRAWINGS

FIG. 3 is a chart for explaining one example of a data structure of a patient priority table in the first embodiment;

FIG. 4 is a chart for explaining one example of a data structure of a threshold table in the first embodiment;

FIG. 5 is a chart for explaining one example of a data structure of a priority setting table in the first embodiment;

DESCRIPTION OF THE PREFERRED EMBODIMENTS

Figure 1:
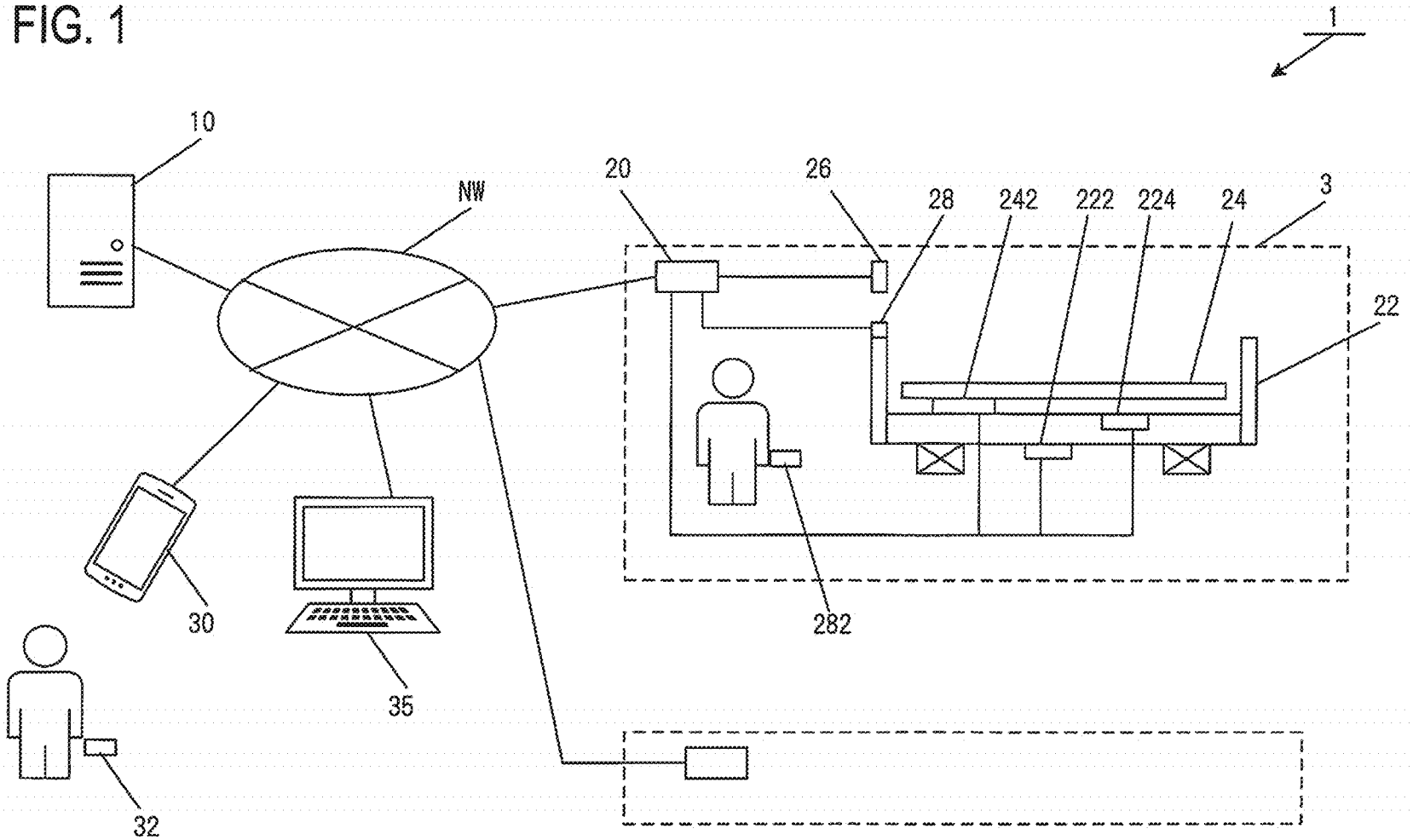
FIG. 1 is a diagram for illustrating the entire system in a first embodiment.

In general, one aspect of the present application is a management system includes, a sensor configured to detect biological information on a user, a communication unit capable of communicating with a terminal device and capable of receiving the biological information, a controller configured to detect whether the user is awake or gets out of the bed, based on the received biological information and activate an alarm to the terminal device, and a display configured to prioritize the alarm related to the user which has a high possibility of falling off the bed.

Another aspect of the present application is a non-transitory computer readable medium including instruction executable by a processor to: receive biological information on a user from a sensor, detect whether the user is awake or gets out of the bed, based on the received biological information, activate an alarm to the terminal device when the user awake or gets out of the bed, and prioritize the alarm related to the user which has a high possibility of falling off the bed.

One or more embodiments are now described with reference to the drawings, wherein like reference numerals are used to refer to like elements throughout. In the following description, for purposes of explanation, numerous specific details are set forth in order to provide a thorough understanding of the various embodiments. It is evident, however, that the various embodiments can be practiced without these specific details (and without applying to any particular networked environment or standard).

As used in this disclosure, in some embodiments, the terms "component," "system" and the like are intended to refer to, or comprise, a computer-related entity or an entity related to an operational apparatus with one or more specific functionalities, wherein the entity can be either hardware, a combination of hardware and software, software, or software in execution. As an example, a component may be, but is not limited to being, a process running on a processor, a processor, an object, an executable, a thread of execution, computer-executable instructions, a program, and/or a computer. By way of illustration and not limitation, both an application running on a server and the server can be a component.

One or more components may reside within a process and/or thread of execution and a component may be localized on one computer and/or distributed between two or more computers. In addition, these components can execute from various computer readable media having various data structures stored thereon. The components may communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software application or firmware application executed by a processor, wherein the processor can be internal or external to the apparatus and executes at least a part of the software or firmware application. As yet another example, a component can be an apparatus that provides specific functionality through electronic components without mechanical parts, the electronic components can comprise a processor therein to execute software or firmware that confers at least in part the functionality of the electronic components. While various components have been illustrated as separate components, it will be appreciated that multiple components can be implemented as a single component, or a single component can be implemented as multiple components, without departing from example embodiments. Further, the various embodiments can be implemented as a method, apparatus or article of manufacture using standard programming and/or engineering techniques to produce software, firmware, hardware or any combination thereof to control a computer to implement the disclosed subject matter. The term "article of manufacture" as used herein is intended to encompass a computer program accessible from any computer-readable (or machine-readable) device or computer-readable (or machine-readable) storage/communications media. For example, computer readable storage media can comprise, but are not limited to, magnetic storage devices (e.g., hard disk, floppy disk, magnetic strips), optical disks (e.g., compact disk (CD), digital versatile disk (DVD)), smart cards, and flash memory devices (e.g., card, stick, key drive). Of course, those skilled in the art will recognize many modifications can be made to this configuration without departing from the scope or spirit of the various embodiments.

In addition, the words "example" and "exemplary" are used herein to mean serving as an instance or illustration. Any embodiment or design described herein as "example" or "exemplary" is not necessarily to be construed as preferred or advantageous over other embodiments or designs. Rather, use of the word example or exemplary is intended to present concepts in a concrete fashion. As used in this application, the term "or" is intended to mean an inclusive "or" rather than an exclusive "or". That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Embodiments described herein can be exploited in substantially any wireless communication technology, comprising, but not limited to, wireless fidelity (Wi-Fi), global system for mobile communications (GSM), universal mobile telecommunications system (UMTS), worldwide interoperability for microwave access (WiMAX), enhanced general packet radio service (enhanced GPRS), third generation partnership project (3GPP) long term evolution (LTE), third generation partnership project 2 (3GPP2) ultra mobile broadband (UMB), high speed packet access (HSPA), Z-Wave, Zigbee and other 802.XX wireless technologies and/or legacy telecommunication technologies.

Hereinafter, one mode for carrying out the present embodiment will be described with reference to the drawings. Various notifications or alarms are activated and transferred to the care givers like medical workers, staff, in accordance with the condition of the patient. Considering that patients which are high possibility of falling off their beds get out of their beds of their own will, a system may active alarms when each patient wakes up. However, if the alarms are activated more than necessary, the necessary alarms may be overlooked.

As another example, in a case of a patient who does not press the nurse call button (call notification) when getting out of the bed, it is preferable that the alarms are activated when the patient takes side sitting position on the bed before getting out of the beds. However, if the alarms are activated from all the patients before they get out of their beds, more alarms than needed are transferred.

Therefore, the present embodiment provides a management system that can determine the priority of each patient and prioritize the alarms related to the users who are treated as high priority in accordance with the priority of each patient. The management system may not show some alarms related to the users who are designated at a low priority. Further, the present embodiment also provides a higher safety system by limiting not only the alarms but also the operations of the bed.

Though the system in this specification will be described by taking an example of a system in a hospital, it is possible to apply the system to management systems for nursing facilities and home nursing.

In addition, in the description, the term "patient" refers to a person using a bed (mattress), and is not limited to a person who receives medical treatment for illness, but also a person who receives nursing care at a facility or a person who goes to bed in a bed can be regarded as "patient".

1. First Embodiment

1.1 System Configuration

Referring first to FIG. 1, the entire system and the functional components of the present system will be described. FIG. 1 is a diagram for explaining the whole of a system 1 and the functional configuration of each component. In the system 1, a server 10, an access point 20, a mobile terminal 30 and a terminal device 35 are connected to a network NW. Here, another server used in a hospital or a facility may be connected to the network NW. Further, the network NW may be any line, either LAN or WAN.

The server 10 manages information on the patients in the present embodiment. Information on a patient includes basic information on the patient such as name, gender and age, medical information such as disease name and biological information on treatment and medication, information of the states of the patients and the like. The server 10 is an apparatus that enables the operator to input and view these data.

The access point 20 is a consolidating device installed in each hospital room (e.g., a hospital room 3 in FIG. 1), and is a relay point for connecting various devices to the network NW. For example, the access point 20 may communicate with other devices via wireless LANs such as IEEE 802.11a/b/g/n or connect with various devices by using short-range wireless communication such as Bluetooth (registered trademark). In addition, connection may be established by wires instead of radio waves.

In the hospital room 3, one or a plurality of beds are arranged. In the present embodiment, for convenience of explanation, FIG. 1 assumes there is only one bed 22 in the hospital room 3. The bed 22 has an actuating function provided with a driver capable of raising and lowering the bed height. In addition, forms of the bed 22 are controlled by the driver (actuator) coupled with the bed sections via linkage so as to control movements such as back-raising, (back-lowering), knee-raising (knee-lowering) and leg-raising (leg-lowering). The bed sections include at least a back section, a lower leg section, an upper leg section.

In FIG. 1, the drive controller 222 for controlling the above-described driver is connected to the access point 20.

The access point 20 is also connected to a patient status detector 224 that obtains the patient's condition and to a biological information sensor 242 (biological information obtaining equipment) that obtains biological signals from the patient in a manner communicatable with each other.

In the present embodiment, the sentence "a device or configuration is connected" indicates a concept that includes not only direct connection but also indirect connection. That is, the word "connect" includes at least meanings of "physically connect", "electrically connect", and "communicate with another component through networks". For example, the biological information sensor 242 may be directly connected to the access point 20, or may be connected once to a display device near the bed and connected by communication to the access point 20 via the display device. Further, for example, the biological information sensor 242 (or patient status detector 224) is connected to the server 10 by communication via the access point 20.

The biological information sensor 242 obtains biological information on a patient. For example, the biological information sensor 242 detects biological signals from sensors set on the body of the patient or sensors provided between the patient and the mattress (or bed) and obtains the biological information on the patient based on the biological signals.

Examples of the sensor provided on the patient's body include sensors provided on arms or chest by the medical staff or the patient themself. The sensor may be, for example, an infrared sensor, a sensor that detects weak electricity, a sensor that detects vibration, or the like. By using these sensors, the biological information sensor 242 can collect various kinds of information such as heartbeat (heartbeat waveform and pulse rate), respiration (respiration waveform and respiratory rate), body motion, etc. of the patient.

Further, the sensors arranged between the patient and the mattress 24 (bed) may include pressure detection sensors, load sensors, sound detection sensors and the like. By using these sensors, the biological information sensor 242 can collect, as biological information, heartbeat, respiration, body motion, states of the patient (a sleeping state, an awake state), sleeping position and the like of the patient.

In addition, the biological information sensor 242 can collect biological information mainly in real time, but may periodically collect at predetermined time intervals. Further, although in the above description, the biological information sensor 242 is assumed to use sensors that directly or indirectly touch the patient, non-contact devices such as infrared sensors, cameras and the like installed at the side of the bed may be used to collect biological information.

The patient status detector 224 may be provided in the mattress 24, the bed 22, or their surroundings to detect whether the patient is in or out of bed. In addition, the patient status detector 224 can detect the posture and position of the patient when the patient is in bed. The patient status detector 224 can obtain vibration data from a pressure sensor placed under the bed, an infrared sensor installed in the bed or around the bed, or a load sensor provided in the bed, and can detect the state of the patient, e.g., getting out of bed, staying in bed, position, posture and others, based on the vibration data.

Regarding to the means for detecting patient's bed leaving, staying in bed, position, posture and others, a user state detecting method is described in Japanese Patent Application Laid-Open No. 2008-206869 (the title of the invention: a bed, filing date: Feb. 27, 2007) and a user position detecting method is described in Japanese Patent Application Laid-Open No. 2009-118980 (the title of the invention: a system of detecting the state of a user in bed, filing date: Nov. 13, 2007). The entire contents of these patent applications are incorporated by reference.

It is also possible to detect whether the patient is getting out of the bed, position and posture from change in pressure detected from sensors placed between the patient and the mattress (the section of the bed). A method for detecting whether the patient is in the bed or not is described in Japanese Patent Application Laid-Open No. 2002-327624 (the title of the invention: a device of detecting in/out of bed, filing date: Nov. 11, 2002), a detecting method is described in Japanese Patent Application No. 2002-327632 (the title of the invention: a device for detecting a positional shift on the bed, filing date: Nov. 11, 2002), and a detecting method is described in Japanese Patent Application No. 2002-327633 (the title of the invention: a device for positional detection on the bed, filing date: Nov. 11, 2002). The entire contents of these patent applications are incorporated by reference.

Noted that the patient status detector 224 may be integrated with the above-described biological information sensor 242. For example, the sensor devices placed between the patient and the mattress (the section of the bed) may enable the biological information sensor 242 to obtain biological information. Likewise, with the sensor devices, the patient status detector 224 can detect the patient conditions.

For convenience of explanation, biological information is obtained by the biological information sensor 242, and the patient condition is detected by the patient status detector 224, but the server 10 may directly obtain these information and patient condition. That is, the biological information sensor 242 transmits biological signals to the server 10. The controller 100 of the server 10 obtains (computes) the biological information based on the received biological signals.

In addition, the patient status detector 224 transmits vibration data to the server 10. The controller 100 of the server 10 detects (computes) the patient condition based on the received vibration data.

Further the access point 20 is connected to a nurse call 26 and an authentication information receiver 28. The nurse call 26 obtains nurse calls (call notification) from patients. When a patient pushes the nurse call button, a nurse call signal is transmitted to the server 10. For convenience of explanation, the server 10 receives nurse calls, but a nurse call server may be provided apart from the server 10.

The authentication information receiver 28 receives authentication information from an authentication card 282 possessed by a patient or the care givers. For example, the authentication information receiver 28 and the authentication card 282 can be connected by short-range wireless communication such as RFID and NFC. The authentication information receiver 28 transmits the authentication information received from the authentication card 282 to the server 10 through the access point 20.

The system may be provided for every hospital room or may be provided for every bed. That is, the above-described configuration is configured for each bed, and is connected to the access point 20 provided for each room.

A mobile terminal 30 and a terminal device 35 are devices for medical workers, staff, and the care givers to check information and log in to the server 10 to change settings.

The medical workers and staff log in to the mobile terminal 30 and the terminal device 35 (system 1) by using their own authentication card 32.

The mobile terminal 30 and the terminal device 35 may behave in the same way, or may be used separately for different functions. While the mobile terminal 30 is carried by a medical worker or staff, or the care givers, the terminal device 35 is installed in the nurse station or the like. In the following embodiment, a case where the mobile terminal 30 is used will be described.

In addition to the above-described server devices, for example an electronic medical record server for managing patient's treatment information and the like, an accounting server for managing account information and the like can be connected to the network NW as necessary.

The configuration of the system 1 described in FIG. 1 is an example of the description in this embodiment, and other configurations may be adopted. For example, a plurality of mobile terminals 30 and a plurality of terminal devices 35 may be provided. Particularly, the medical workers, staff, and care givers may each be given a mobile terminal 30 so as to be able to check the conditions of patients and information on the patients.

Also, the system configuration may be further subdivided, but in the present embodiment, the necessary configuration is simplified for convenience of explanation. As a possible system example, each system (server) is connected to an order system including an electronic medical record system. Examples of the systems connected to the order system include systems (servers) having particular roles, such as a pharmacy system, a medication management guidance recording system, an ICU management system, an ME clinical system, a nursing support system, a goods management system (equipment management system), a medical accounting system, a surgical management system and the like.

When a plurality of systems are integrally configured, the above-described various kinds of information are stored and managed as appropriate in each system as necessary.

1.2 Device Configuration

1.2.1 Configuration of Server

Figure 2:
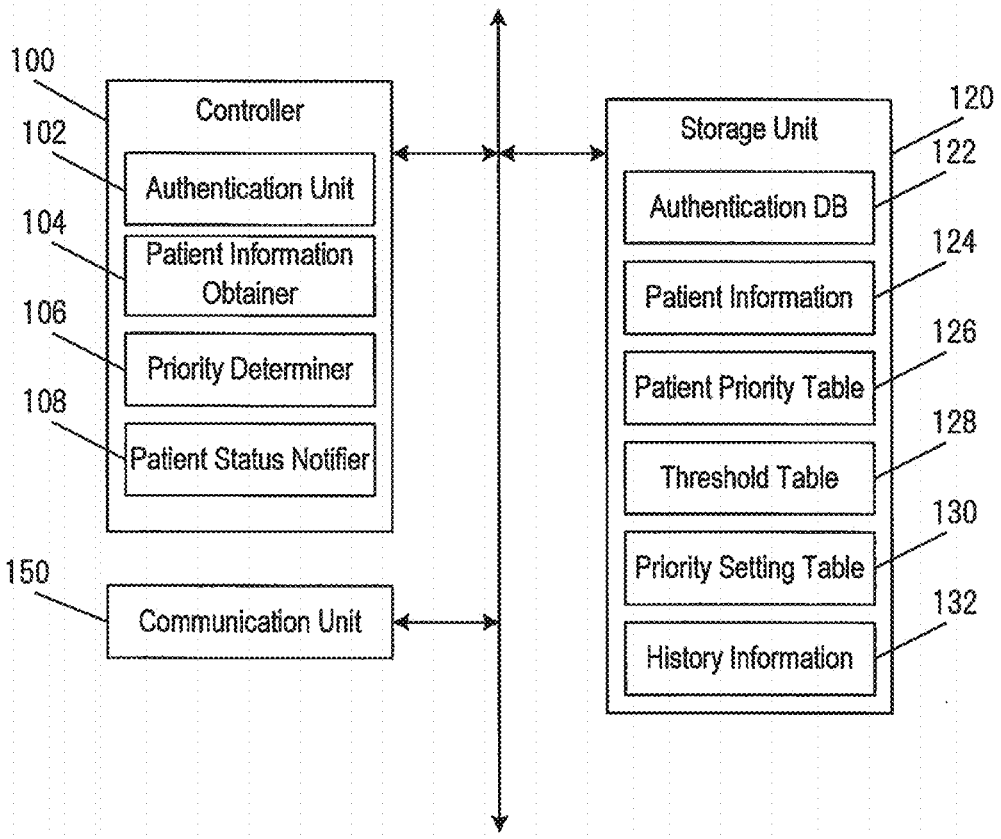
FIG. 2 is a diagram for explaining a functional configuration of a server in the first embodiment.

Next, the configuration of the server 10 will be described with reference to FIG. 2. As shown in FIG. 2, the server 10 includes a controller 100, a storage unit 120 and a communication unit 150.

The controller 100 controls the management apparatus 10 as a whole. The controller 100 implements various functions by reading out and executing various programs stored in the storage unit 120, and is configured of, for example, a CPU (Central Processing Unit).

The controller 100 reads out and executes the programs stored in the storage unit 120, to thereby perform functions of an authentication unit 102, a patient information obtainer 104, a priority determiner 106 and a patient status notifier 108.

The authentication unit 102 authenticates patients, medical workers and staff based on the authentication information read from the authentication card. Specifically, the authentication unit 102 collates authentication information with an authentication database (DB) 122 stored in the storage unit 120.

The patient information obtainer 104 obtains the biological information obtained by the biological information sensor 242 and the state of the patient detected by the patient status detector 224 as the information on the patient. That is, the patient information obtainer 104 can obtain biological information such as a heart rate and respiration of a patient and the state of patient (a sleeping state, an awaken state) and information whether the patient is staying in bed or not, the patient's posture on the bed and patient's position on the bed.

The patient information collected by the patient information obtainer 104 is stored in the storage unit 120 as patient information 124. The patient information 124 will be described later.

The priority determiner 106 determines the priority of each patient by a priority determining process. For example, the priority determining process determines that the priority is "high" or "low" for each patient, and stores the priority of each patient to a patient priority table 126.

The patient status notifier 108 activates and transfers alarms and the patient information obtained by the patient information obtainer 104, in accordance with the priority determined in the priority determiner 106. Alarms and patient information are displayed to the mobile terminal 30 and the terminal device 35, as destination.

The storage unit 120 stores various programs and various data necessary for the operation of the server 10. The storage unit 120 is composed of, for example, a semiconductor memory (SSD), an HDD (Hard Disk Drive) and the like.

The storage unit 120 stores the authentication DB 122, the patient information 124, the patient priority table 126, a threshold table 128, a priority setting table 130 and history information 132.

The authentication information DB (database) 122 stores authentication information used by the authentication unit 102. Specifically, authentication information is stored in association with a user ID of a patient, a medical worker or the like. Further, usage authority may be added to the user ID. For example, if the user is a "physician", the user can register the medication information. If the user is a "care giver", the user can answer to nurse calls.

The patient information 124 stores patient information. The patient information includes basic information such as patient ID, name, age, height, weight, and medical history, presence or absence of fall risk, necessity of wheelchair use and other various kinds of information. In addition, as information on medical care, the hospital room (floor) where a patient stays, doctors and nurses (main and sub) in charge of the patient and the like are also stored in the patient information 124 of the storage unit 120.

In addition, real-time information on the patient is also stored in the patient information 124 of the storage unit 120. The real-time information changes with time, and typical examples are as follows:

(1) biological information such as heartbeat, respiration, etc. of the patient;

(2) biological information values of heart rate and respiration rate based on heartbeat, rate of breathing etc. of the patient; and (3) the state of the patient whether the patient is sleeping or is awake, the state of the patient related to the depth of sleeping of the patient, and the patient's posture and the patient's position.

Among the patient information stored in the patient information 124, the real-time information may be updated as required or may be stored accumulatively. Alternatively, the information may be periodically collected and stored at predetermined time intervals (for example, every minute, every 30 minutes, every hour, every night, every day, etc.).

The patient priority table 126 stores information on the priority of each patient. Based on the priority of the patient, the patient status notifier 108 determines whether or not to notify the patient's state. For example, as shown in FIG. 3, the patient priority table 126 includes a patient ID (e.g., "K001") for specifying patients, priority for determination (e.g., "high") and thresholds (priority determining thresholds) to be used for priority determination.

As the priority for determination, the priority determined by the priority determiner 106 is stored in the patient priority table 126. The priority determining threshold is a value stored for each patient, whereas an aftermentioned threshold table 128 stores thresholds for the whole or for each group. For example, in FIG. 3, a bed height (e.g., "40 cm") is stored as the priority determining threshold for each patient (e.g., patient ID "K001").

The bed height threshold is determined to be safe for each patient to get out of the bed. That is, the bed height is defined as the height from the floor to the upper surface of the mattress (or the upper surface of the bed sections, the frame which supports the bed sections). Also, the bed height threshold may be determined as appropriate taking into account the patient's height.

The information stored in the patient priority table 126 may be stored in the patient information 124 in association with the patient ID.

The threshold table 128 stores a plurality of thresholds. As shown in FIG. 4, the threshold table 128 stores a bed-exit determining threshold (standard numbers where the patient gets out of the bed from night to morning), a priority threshold (threshold for determining whether the priority of the patient is relatively high or low) and a bed height threshold as the thresholds (priority determining thresholds) to determine priority. Each of the thresholds will be described hereinbelow as appropriate when necessary. These thresholds may be set by a medical worker or a system administrator or may be set by an operator.

These priority determining thresholds are applicable thresholds for every patient, every group and every hospital room. As described with reference to FIG. 3, the priority determining threshold may be stored as a common value or may be stored for each patient. Combination can be taken depending on the type of priority determining threshold.

The priority setting table 130 stores setting conditions for alarms and operations at each priority level. For example, as shown in FIG. 5, the setting conditions for alarms and operations (for example, "awake=ON, bed exit=ON, bed height=ON, . . . " are stored in association with the corresponding high priority level). The "awake-ON" indicates the alarm is activated if the patient is awake. The "bed exit-ON" indicates the alarm is activated if the patient gets out of bed. The "bed hight=ON" indicates the alarm is activated if a height of the bed is higher than the bed height threshold. The patient status notifier 108 reads the priority of the patient from the patient priority table 126 and determines whether or not to activate alarms or operate the bed with reference to the priority setting table 130.

The priority setting table 130 may be stored for the entire system, may be stored for each group (e.g., for each patient room type, for each ward, for medical department, etc.) or may be stored for each patient.

The history information 132 stores information (history information) on various histories in the system 1. For example, the time when the patient made notification (nurse call), the staff who coped with are stored. Further, when "no attention needed" is input through the mobile terminal 30, this fact is stored. Here, the information stored in the history information 132 may be stored together with the patient information 124, for example.

The communication unit 150 communicates with the access point 20, the mobile terminal 30 (terminal device 35), and others through the network NW. For example, the communication unit 150 can connect to the network NW through a wired LAN such as Ethernet (registered trademark) and communicate with other servers.

1.2.2 Configuration of Bed

Figure 6:
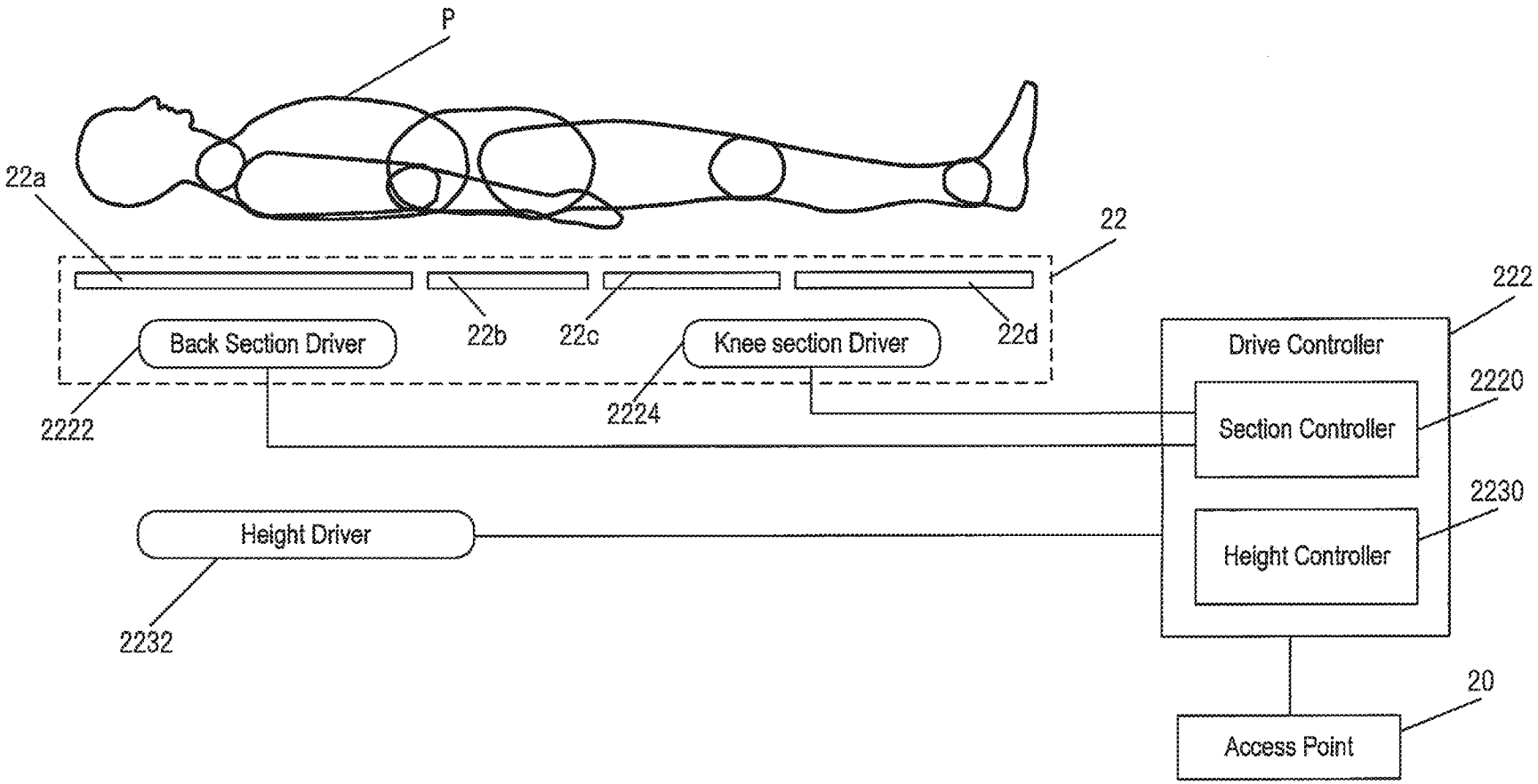
FIG. 6 is a diagram for explaining the configuration of a bed in the first embodiment.

The configuration of the bed 22 will be described. FIG. 6 shows a schematic configuration of the bed 22. The bed 22 has a back section 22*a*, a seat section 22*b*, a upper leg section 22*c* and a lower leg section 22*d*. The upper body of a user P is supported by the back section 22*a*, and the hip of the user is supported by the seat section 22*b*.

The drive controller 222 controls the drive of the bed 22. Here, the drive controller 222 makes the section control 2220 for controlling the back-raising, knee-raising (leg-lowering) and other functions by operating the sections as well as height control 2230 for controlling the height. Further, the drive controller 222 is connected to the access point 20.

Regarding to the back-raising function, the section control 2220 is connected to a back section driver 2222 and a knee section driver 2224. The back section driver 2222 is an actuator and is connected to a linkage mechanism. The back section 22*a* is moved under the control of the back section driver 2222, whereby executing back-raising/back-lowering.

A knee section driver 2224 is an actuator and is connected to a linkage mechanism. The knee section 22*c* connected foot section 22*d* is moved under the control of the knee section driver 2224, whereby executing knee-raising/knee-lowering (leg-lowering/foot-raising).

In addition, the height controller 2230 control the height of the bed 22 (bed sections) by controlling a height driver 2232. The height driver 2232 is, for example, an actuator and controls the height of the entire bed 22 by raising/lowering the entire bed sections.

1.2.3 Configuration of Mobile Terminal

Figure 7:
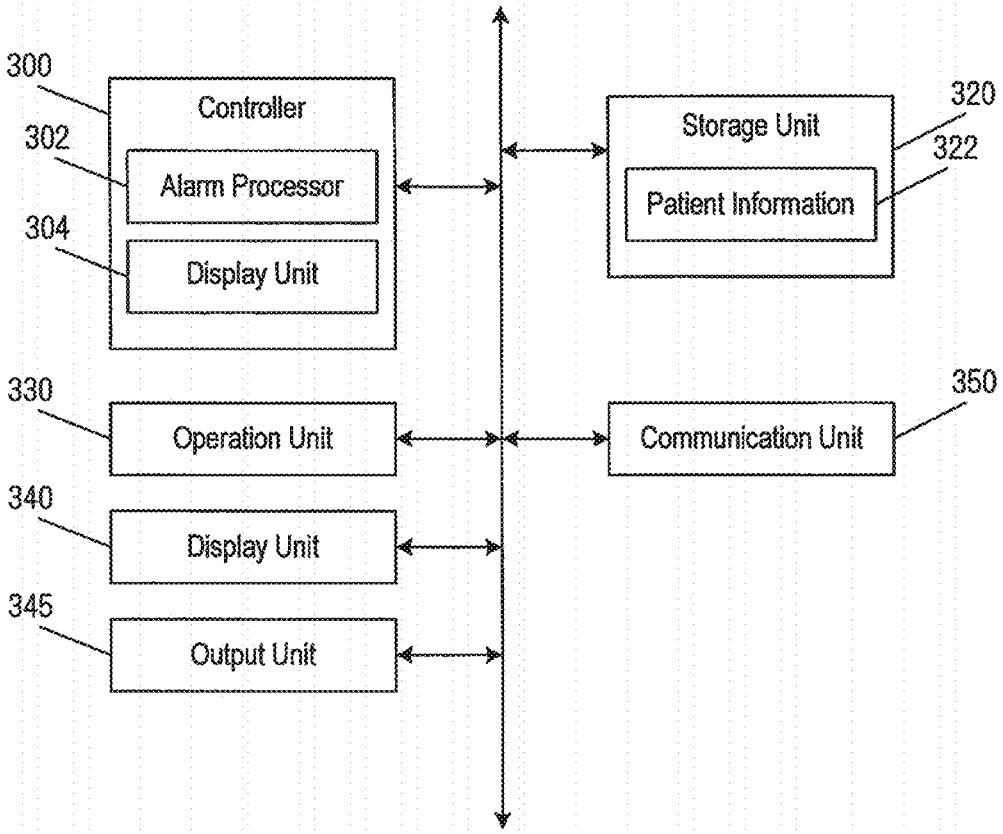
FIG. 7 is a diagram for explaining the configuration of a mobile terminal in the first embodiment.

The configuration of the mobile terminal 30 will be described with reference to FIG. 7. The mobile terminal 30 includes a controller 300, a storage unit 320, an operation unit 330, a display unit 340, an output unit 345 and a communication unit 350. In the present embodiment, the mobile terminal 30 will be described as an example, but the terminal device 35 may also have the same configuration.

The controller 300 controls the entire mobile terminal 30. The controller 300 is capable of executing various functions by reading out various programs stored in the storage unit 320, and is composed of, for example, a CPU (Central Processing Unit).

The controller 300 functions as an alarm processor 302 and a patient information display unit 304 by reading and executing the program stored in the storage unit 320.

The alarm processor 302 activates alarm operation based on signals sent from the patient status notifier 108 of the server 10. The alarm operation includes displaying an alarm on the display unit 340, outputting an alarm sound from an output unit 345 and the like.

The display unit 340 displays information on patients based on the patient information 322 stored in the storage unit 320. For example, information such as patient ID, patient name, patient's posture, biological information, the states of patient, the states whether the patient is staying in the bed or not can be displayed by the display unit 340.

The display unit 304 may display only the patients whom the nurse or the staff is taking charge of. The medical worker, the staff, the care givers logs in to the system 1 (mobile terminal 30) by using the authentication card 32, and can check the information related to only the patients who he/she is taking charge of.

In a case where the system has no authentication function (e.g., a system for home care etc.), information corresponding to only a specific patient may be displayed, or information corresponding to all patients may be displayed in some cases depending on the scale of the hospital/facility The storage unit 320 stores various programs and various data necessary for the operation of the mobile terminal 30. The storage unit 320 is composed of, for example an SSD (Solid State Drive) that is a semiconductor memory, an HDD (Hard Disk Drive) that is a magnetic disk and the like.

The storage unit 160 stores patient information 322 including the above-described patient information 124. The patient information 322 stores information to be displayed on the mobile terminal 30, among the patient information transmitted from the server 10.

The operation unit 330 and the display unit 340 are configured to allow medical workers such as physicians and staff, facility staff, etc., to perform operation input and display the information. That is, the operation unit and the display unit are formed of, for example a liquid crystal display device integrated with a touch panel.

The operation unit 330 enables a person in charge to input content of treatments or prescriptions given to the patients by a specialist such as a doctor, content of treatments and nursing care given by a nurse and content of care giving by a staff, and the like.

The output unit 345 provides notices or alarms under the control of the alarm processor 302. For example, an alarm operation is executed by outputting an alarm sound, by means of a light emitter such as an LED, or by vibration using a vibrator. The alarm operation can be canceled by the operator if the operator confirms these alarms and notices on the display unit 340.

The communication unit 350 communicates with the server 10 through the network NW and communicates with other apparatuses. For example, the communication unit 350 can connect to the network NW through a wireless LAN and communicate with the server 10. Further, an external network such as LTE (Long Term Evolution) may be used to communicate with the server 10.

Further, when the user logs in to the system, the communication unit 350 reads the authentication information as the user holds the authentication card 32 over the communication unit 350. The communication unit 350 in this case is configured of a communication means such as RFID (Radio Frequency Identification), NFC (Near Field Communication) or the like.

As long as authentication information can be read, an image taking device such as a camera can be used to read the authentication information (e.g., authentication information given by a two-dimensional barcode).

1.3 Processing Flow

Next, the flow of processing in the present embodiment will be described with reference to the drawings. In the present embodiment, the priority determiner 106 (controller 100) firstly executes a priority process and decides the priority of each patient. The determined priority (priority for determination) is stored in the patient priority table 126.

The priority determiner 106 (controller 100) executes a priority determining process to determine the priority of the patient. The priority determiner 106 performs the priority determining process periodically. For example, it may be done once a day or every morning. Alternatively, it may be done at intervals of a predetermined period (e.g., 3 hours, 6 hours, 12 hours, 1 day, 2 days, etc.). Furthermore, it may be actuated manually by a medical worker, the staff or the care givers.

The priority determiner 106 stores the determined priority of the patient in the patient priority table 126. When the priority is collectively managed with the patient information 124, the priority determiner 106 may store it in the patient information 124.

Thereafter, the patient status notifier 108, referring to the priority for determination stored in the patient priority table 126, performs an alarm process in accordance with the priority setting table 130. The priority determining process will be described first. Various methods are conceivable as the priority determining process, but the following method will be described as an example.

1.3.1 First Priority Determining Process

Figure 8:
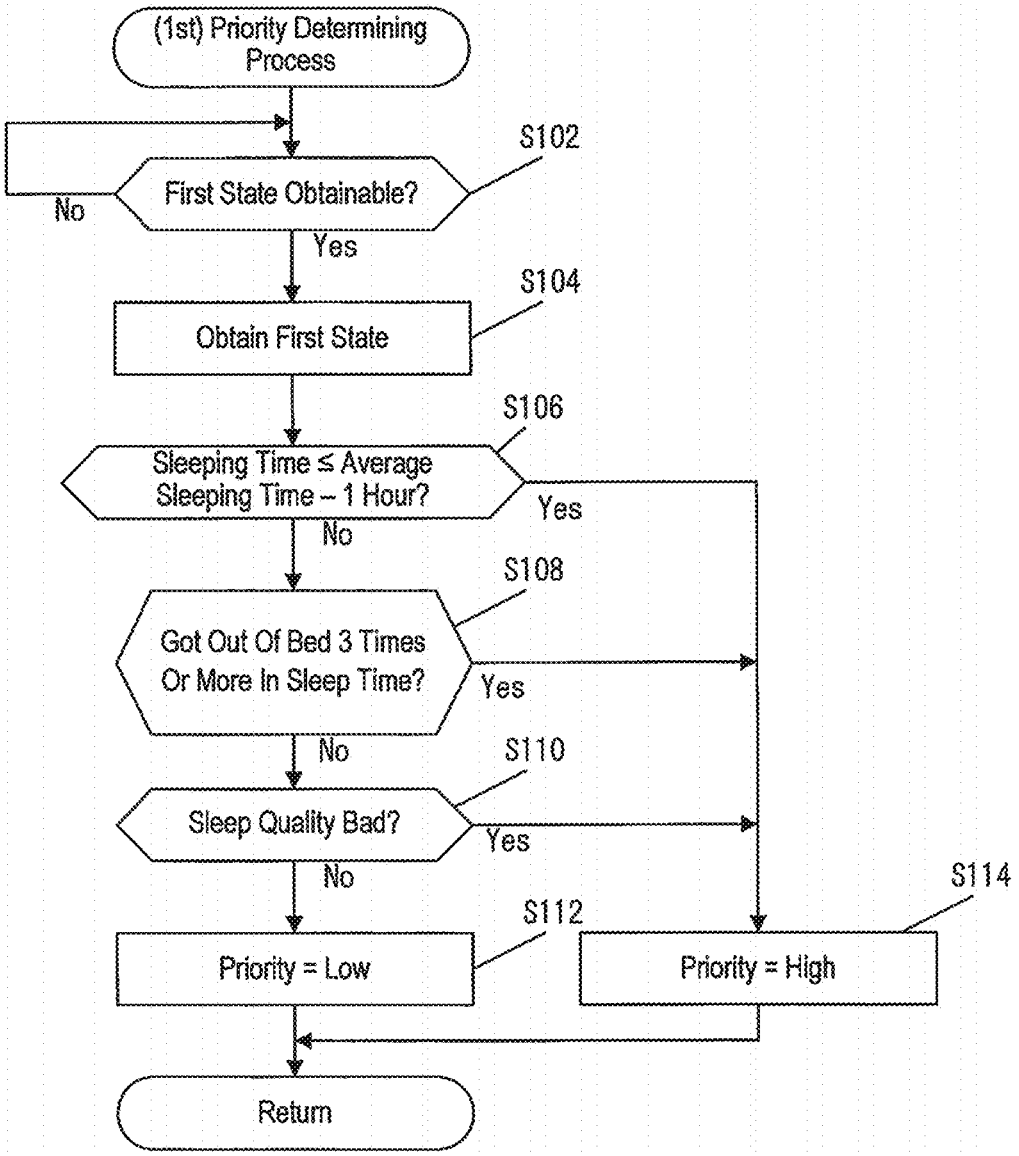
FIG. 8 is a flowchart illustrating a first priority determining process in the first embodiment.

A first priority determining process will be described with reference to FIG. 8. The first priority determining process determines the priority according to the state of the patient, especially quality of sleep of the patient. We call the state of the patient as to whether the patient is sleeping or awake as a first state.

If the first state of the patient is obtainable, the priority determiner 106 obtains the first state of the patient (Step S102; Yes→Step S104). The first state of the patient is determined by the patient information obtainer 104, based on the biological information obtained by the biological information sensor 242.

The priority determiner 106 obtains the first state of the patient in a predetermined period at the step S104. Specifically, the predetermined period corresponds to a period from night to morning.

The priority determiner 106 calculates a sleeping time based on the obtained first state in the predetermined period. If the calculated sleeping time is one hour shorter than the average sleeping time, the priority determiner 106 determines that the priority of the patient is "high" (Step S106; Yes→Step S114).

If we redefine the first state as the state of the patient as to whether the patient is sleeping or awake and as to a depth of the sleeping of the patient, the priority determiner 106 may calculate a sleeping time which the sleeping depth of the patient is equal or less than a threshold level in the predetermined period.

We may redefine the first state as the state of the patient as to whether the patient is sleeping or awake, as to a depth of the sleeping of the patient, and whether the patient is in the bed or not for some circumstance.

The priority determiner 106 determines the quality of sleep of the patient is regarded to be low from the fact that the sleeping time is one hour shorter than the average sleeping time. The average sleeping time may be the average sleeping time of the patient or the set average sleeping time. At Step S106, the sleeping time one hour shorter than the average sleeping time is used for determination, but a different period of time such as 30 minutes or 2 hours shorter, for example, may be used instead of 1 hour.

If the number of times the patient got out of the bed during the predetermined period exceeds a predetermined number of times (e.g., three times in FIG. 8), the priority determiner 106 regards that the quality of sleep is low and determines the priority to be "high" (Step S106; No→Step S108; Yes→Step S114).

Other than the above criteria, if the priority determiner 106 can determine that the quality of sleep is bad, the priority is determined to be "high" (Step S108; No→Step S110; Yes→Step S114).

Regarding to a method of evaluating the quality of sleep, a sleep quality evaluation method is described in Japanese Patent Application Laid-Open No. 2013-45336 (the title of the invention: a sleep state evaluation device and the like, filing date: Aug. 25, 2011). The entire contents of this patent application are incorporated by reference.

If none of the above-described steps from step S106 to S110 are satisfied (Step S106; No→Step S108; No→Step S110; No), the priority of the patient is determined to be "low" (Step S112).

1.3.2 Second Priority Determining Process

A second priority determining process will be described with reference to FIG. 9. The second priority determining process determines the priority of a patient considering the personality of the patient (e.g., whether or not the patient presses the nurse call button) when the patient gets out of the bed.

When the patient status detector 224 detects the patient getting out of the bed (Step S202; Yes), the priority determiner 106 detects whether or not the nurse call button is pressed (Step S204).

Here, when the nurse call button has been pressed before and after the patient got out of the bed is detected (Step S204; No), the priority determiner 106 goes to next step S208, if the patient has got out of the bed without pressing the nurse call button, the priority determiner 106 increments a determination count C as a variable by 1 (Step S204; Yes→Step S206).

The priority determiner 106 repeats steps S202 to S206 until the number of times the patient got out of the bed exceeds the bed-exit determining threshold (e.g., "4 times" stored in the threshold table 128 shown in FIG. 4).

When the number of times exceeds the bed-exit determining threshold, the priority determiner 106 determines whether or not the determination count C exceeds the priority threshold (e.g., "2 times" stored in the threshold table 128 shown in FIG. 4) (Step S210).

Then, when the determination count C exceeds the priority threshold, the priority determiner 106 determines that the priority of the patient is "high" (Step S210; Yes→Step S212). When the determination count C does not exceed the priority threshold, the priority determiner 106 determines that the priority of the patient is "low" (Step S210; No→Step S214).

In this process, the priority determiner 106 determines whether or not the determination count C exceeds the priority threshold, that is, whether or not the patient has got out of the bed without pressing the nurse call button at a number of times equal to or greater than the priority threshold within a predetermined time interval. The priority determiner 106 can determine the priority of the patient based on a proportion within a predetermined time interval. For example, when a patient got out of the bed, more frequently than 20% of the total number the patient got out of the bed without pressing the nurse call button within 6 hours, the priority determiner 106 may determine that the priority of the patient is "high".

1.3.3 Third Priority Determining Process

Figure 10:
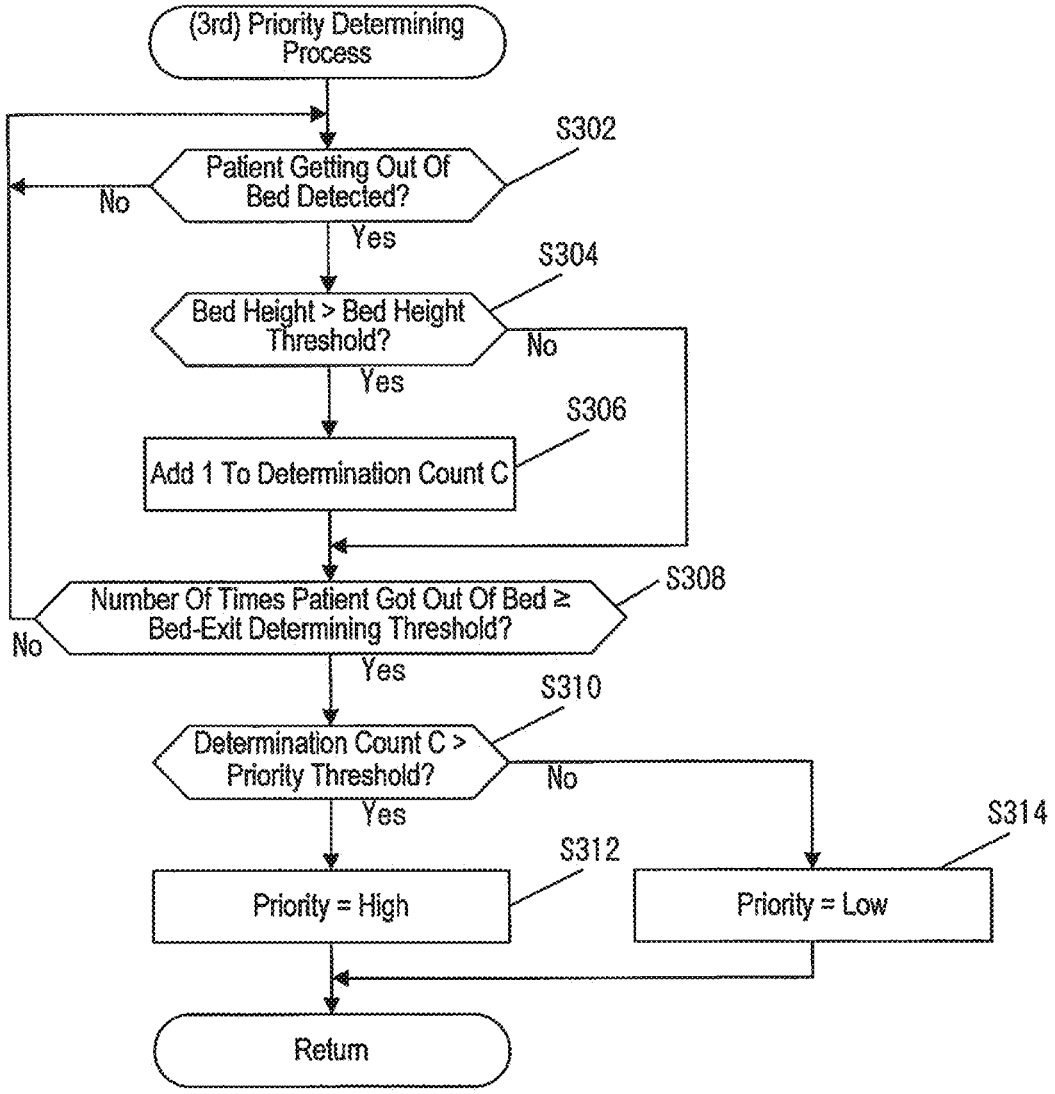
FIG. 10 is a flowchart illustrating a third priority determining process in the first embodiment.

A third priority determining process will be described with reference to FIG. 10. The third priority determining process determines the priority of a patient considering the bed height when the patient gets out of the bed, especially whether the bed height is suitable for the patient.

When the patient status detector 224 detects the patient getting out of the bed (Step S302; Yes), the priority determiner 106 determines whether or not the bed height exceeds the bed height threshold in the threshold table 128 (Step S304).

Here, the priority determiner 106 obtains the bed height by the drive controller 222 (the height control 2230). The bed height threshold uses the value (e.g., "40 cm") stored in the threshold table 128 shown in FIG. 4.

Here, if the bed height is equal to or less than the bed height threshold (Step S304; No), the priority determiner 106 goes to the next step S308, if the patient has got out of the bed at a height greater than the bed height threshold, the priority determiner 106 increments the determination count C as a variable by 1 (Step S304; Yes→Step S306).

Here, the priority determiner 106 repeats steps S302 to S306 until the number of times the patient got out of the bed exceeds the bed-exit determining threshold (e.g., "4 times" stored in the threshold table 128 shown in FIG. 4).

When the number of times exceeds the bed-exit determining threshold, the priority determiner 106 determines whether or not the determination count C exceeds the priority threshold (e.g., "2 times" stored in the threshold table 128 shown in FIG. 4) (Step S310).

Then, when the determination count C exceeds the priority threshold, the priority determiner 106 determines that the priority of the patient is "high" (Step S310; Yes→Step S312). When the determination count C does not exceed the priority threshold, the priority determiner 106 determines that the priority of the patient is "low" (Step S310; No→Step S314).

In this process, the priority determiner 106 determines whether or not the determination count C exceeds the priority threshold, that is, whether or not the patient has got out of the bed with a bed height greater than the height threshold at a number of times equal to or greater than the priority threshold within a predetermined time interval. The priority determiner 106 can determine the priority of the patient based on a proportion within a predetermined time interval. For example, when a patient got out of the bed with a bed height greater than the bed height threshold, more frequently than 20% of the total number the patient got out of the bed within 6 hours, the priority determiner 106 may determine that the priority of the patient is "high".

Further, a plurality of bed height thresholds may be set. For example, as another bed height threshold value, "60 cm" is stored. Then, the priority determiner 106 may determine the priority to be "high" if the patient got out of the bed of a height of "60 cm" or greater even once.

In the priority determining process described above, the priority is classified into two levels, "low" and "high", but the priority may be set with a plurality of levels. For example, in the first priority determining process, the priority can be classified based on the number of times of bed exit. In the second priority determining process, the priority can be classified based on the ratio at which the nurse call button is not pressed. In the third priority determining process, the priority can be classified based on the bed height and the number of times of bed exit.

Figure 9:
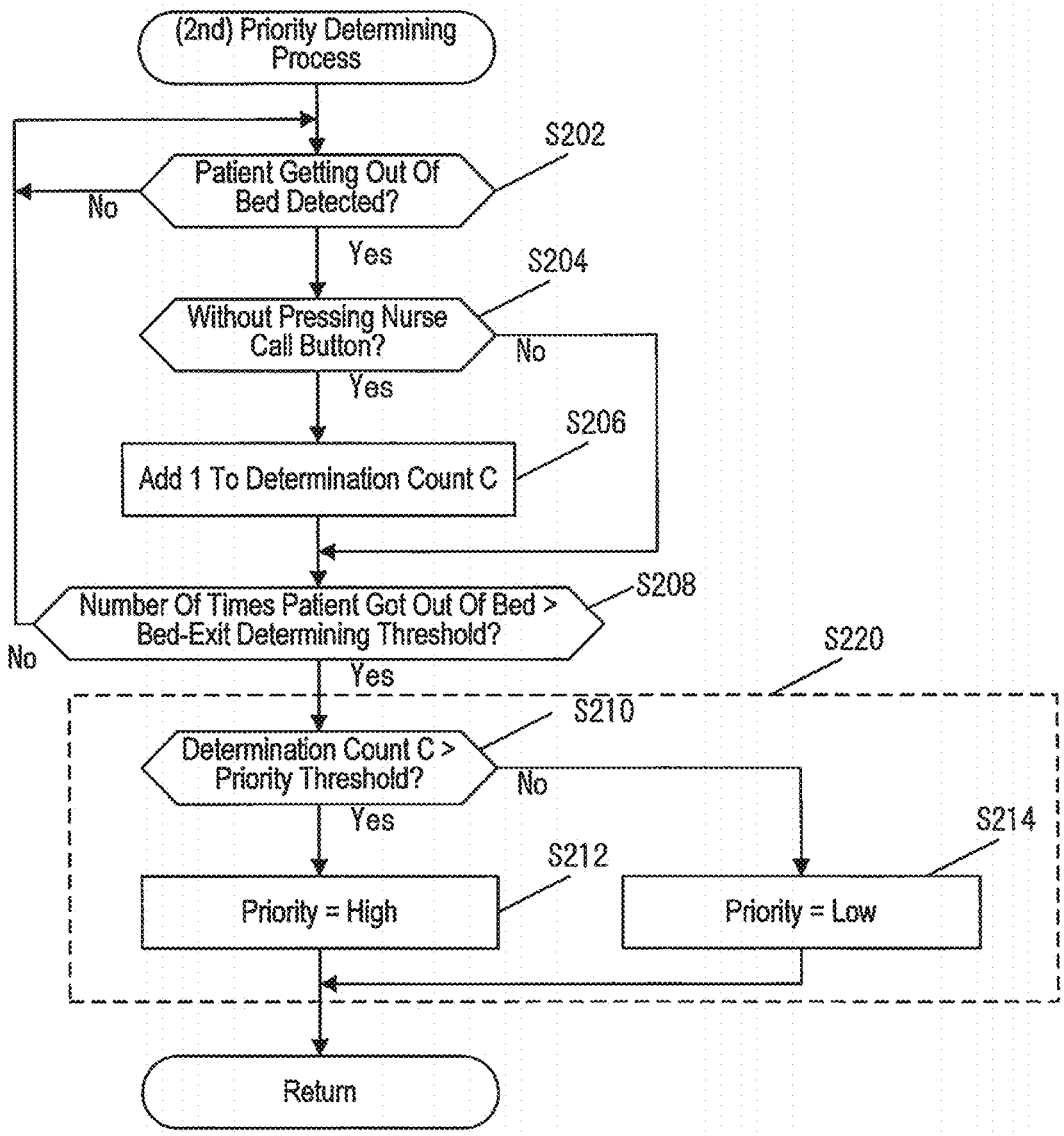
FIG. 9 is a flowchart illustrating a second priority determining process in the first embodiment.

Specifically, the priority determiner 106 executes Step S220 in FIG. 9 as a step of determining one priority. That is, using the determination count C, the priority (priority for determination) may be determined in stepwise manner like "high", "medium", "low".

Further, the priority determining process may make a decision based on other information. For example, the priority may be determined based on the patient's medical condition or medication information. For example, the priority may be set to "high" for two days after surgery, or the priority may be set to "high" if a medicine inducing a high fall risk is prescribed.

In addition, the priority determined once can be changed by the medical workers, the staff, and the care givers. For example, though the priority determining process has determined that the priority is "low", the priority may be changed to "high" when the anesthesia wears off.

1.4 Alarm Process

Figure 11:
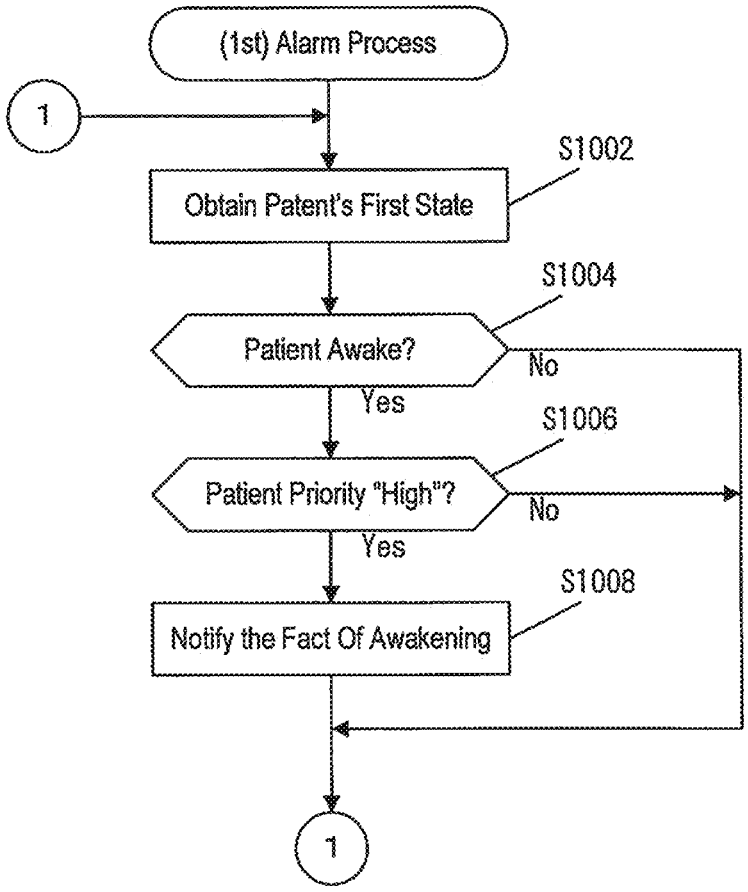
FIG. 11 is a flowchart illustrating a first alarm process in the first embodiment.

Next, with reference to FIG. 11, a description indicates the alarm operation of the patient status notifier 108. The patient status notifier 108 (the controller 100) executes the process executed described in the FIG. 11.

The alarm process is executed when the patient is in bed. Therefore, the process may be executed after the patient once got out of the bed, and when the patient has returned to the bed, when the patient has confined to the bed, or when the patient has got to sleep. The timing for performing the alarm process may be set in the same way for all the patients or may be adjusted in the different way for each patient. Also, the staff may set the timing.

First, the patient status notifier 108 timely obtains the current first state of the patient (Step S1002). Here, the first state of the patient is determined based on the obtained biological information obtained by the patient information obtainer 104. In addition, the patient's first state is the one that is currently obtained. That is, real-time first state is obtained.

Subsequently, when the priority determiner 106 determines that the patient is awake based on the first state (Step S1004; Yes), the patient status notifier 108 determines whether or not the priority of the patient is high (Step S1006). Then, when the priority of the patient is high, the patient status notifier 108 activates alarms and notifies that the patient is awake (Step S1006; Yes→Step S1008).

Specifically, an alarm signal is sent to the mobile terminal 30 (terminal device 35) through the communication unit 150. When the mobile terminal 30 receives the alarm signal through the communication unit 350, the alarm processor 302 executes an alarm process. Thereby, for example, the display unit 340 of the mobile terminal 30 notifies that the patient is awake, or the output unit 345 outputs an alarm sound.

1.5 Screen Operation Example

Next, a screen example in the present embodiment will be described with reference to the drawings. FIGS. 12 to 15 show an example of display screens displayed on a display related to the server 10 or the terminal device 35, and FIG. 16 is an example of a display screen displayed on the mobile terminal 30. The display in FIG. 12 to FIG. 15 may be displayed on a display device connected to the server 10 or may be displayed on a screen of a terminal device 35 which remotely has logged in. Further, the screen may be provided by WEB service or the like.

Figure 12:
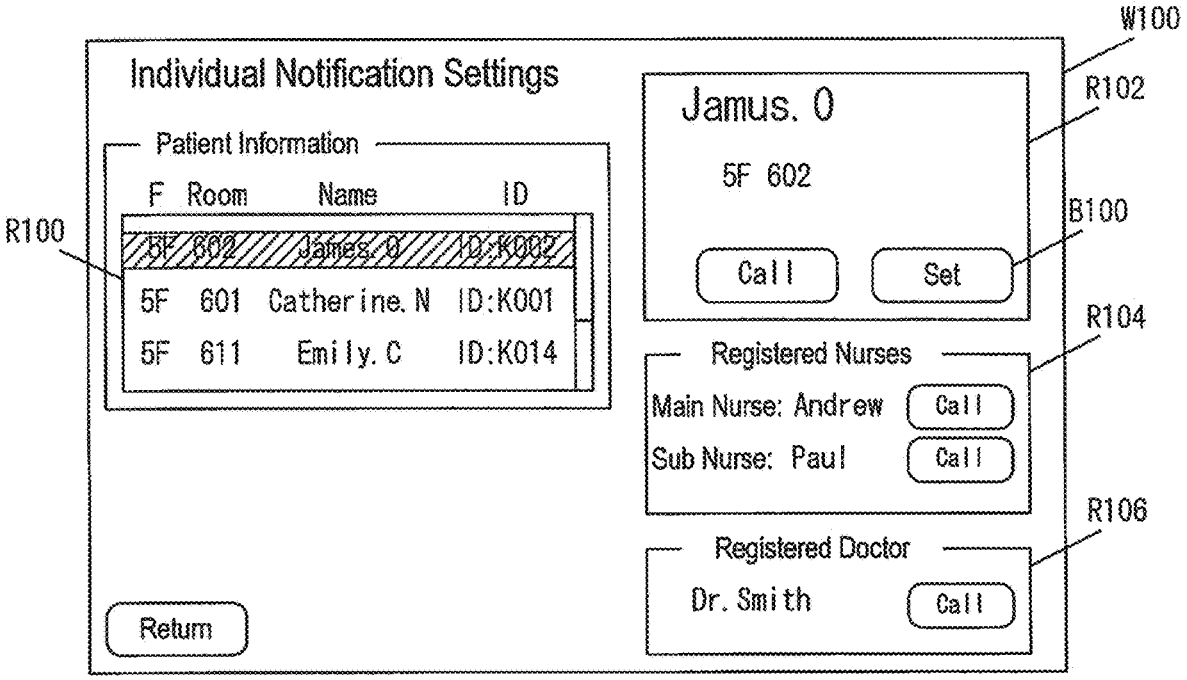
FIG. 12 shows one example of a display screen of the system in the first embodiment.

A display screen W100 in FIG. 12 is a setting screen for setting notification for each patient. The display screen W100 displays a patient list in an area R100, from which a patient can be selected by the staff or the care givers.

Highlighted patient in the area R100 is a selected patient. The area R102 indicates detail information about the selected patient. The nurses for the patient are displayed in an area R104, and the doctor who is in charge of is displayed in an area R106. If a setting button B100 displayed in the area R102 is selected (e.g., touched), the display is switched into a display screen W110 shown in FIG. 13.

Figure 13:
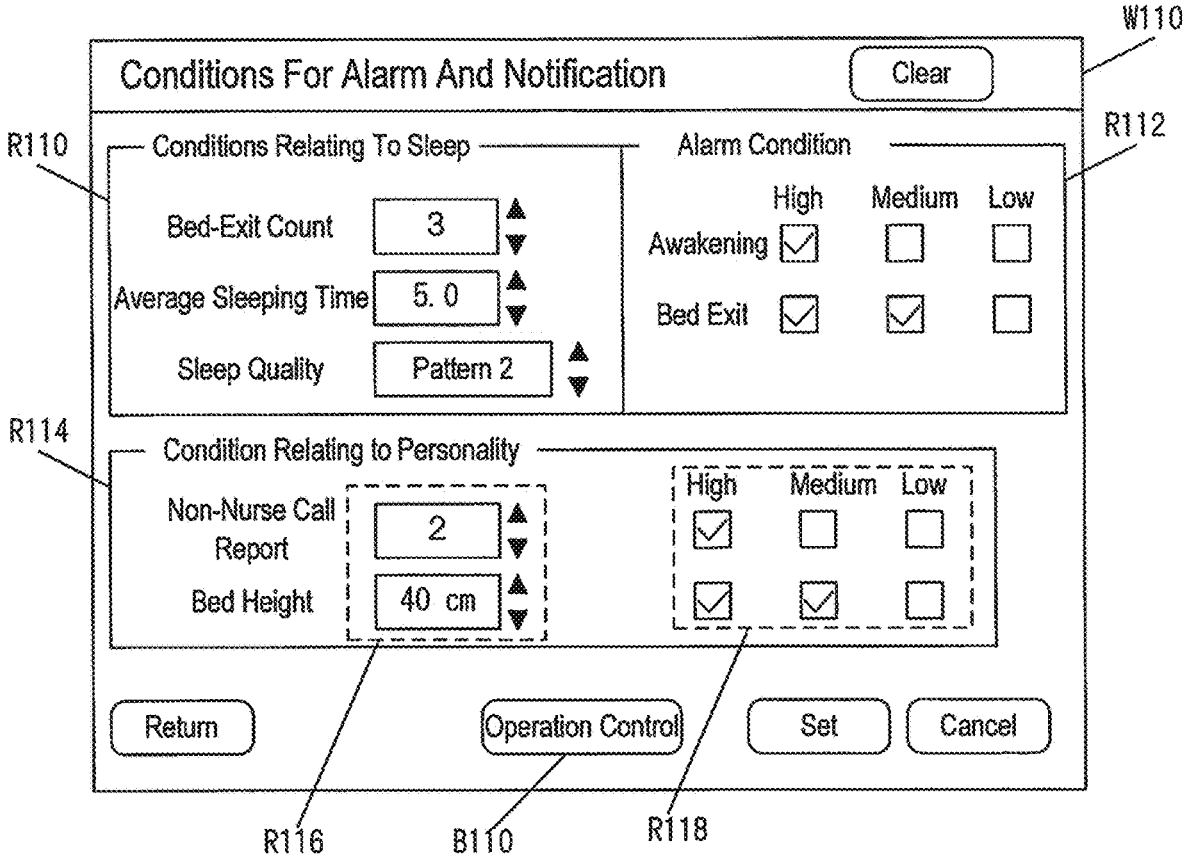
FIG. 13 shows one example of the display screen of the system in the first embodiment.

The display screen W110 of FIG. 13 is a screen on which the care givers for example can set condition to be notified and alarmed by the patient status notifier 10. It is also possible to set thresholds when the priority determiner 106 determines the priority (priority for determination) of the patient.

For example, the area R110 corresponds to a setting area for conditions relating to sleep, and allows setting of thresholds relating to sleep (or relating to bed exit). The priority determiner 106 uses these conditions in R110 to determine whether the alarm should be activated and notified. The area R112 allows setting of the priority to be notified and alarmed as the condition for notifying the state of the patient.

For example, in the case of FIG. 13, when the patient awakens, the patient status notifier 108 activates alarms and provides notices if the priority of the patient is "high". However, if the priority is "medium" or "low", the patient status notifier 108 will not activate alarms and provide notices.

Also, as in an area R114, it is possible to set thresholds for determining the priority, together with whether or not the patient status notifier 108 activates the alarms and provides notices according to the priority. For example, an area R116 corresponds to a setting area for setting thresholds, and an area R118 corresponds to a setting area for setting condition for the alarm.

For example, in FIG. 13, the bed height is set at "40 cm" and the priority "high" is selected as the condition for the alarm. Therefore, when the bed height is equal to or greater than "40 cm", if the patient gets out of the bed, the patient status notifier 108 activates alarms and provides notices of the patients with "high" priority. With reference to the condition for the alarm in the area R112, it is understood that the alarm is triggered by "awakening" and "bed exit". The "bed exit" indicates detecting the patient gets out of the bed.

Figure 14:
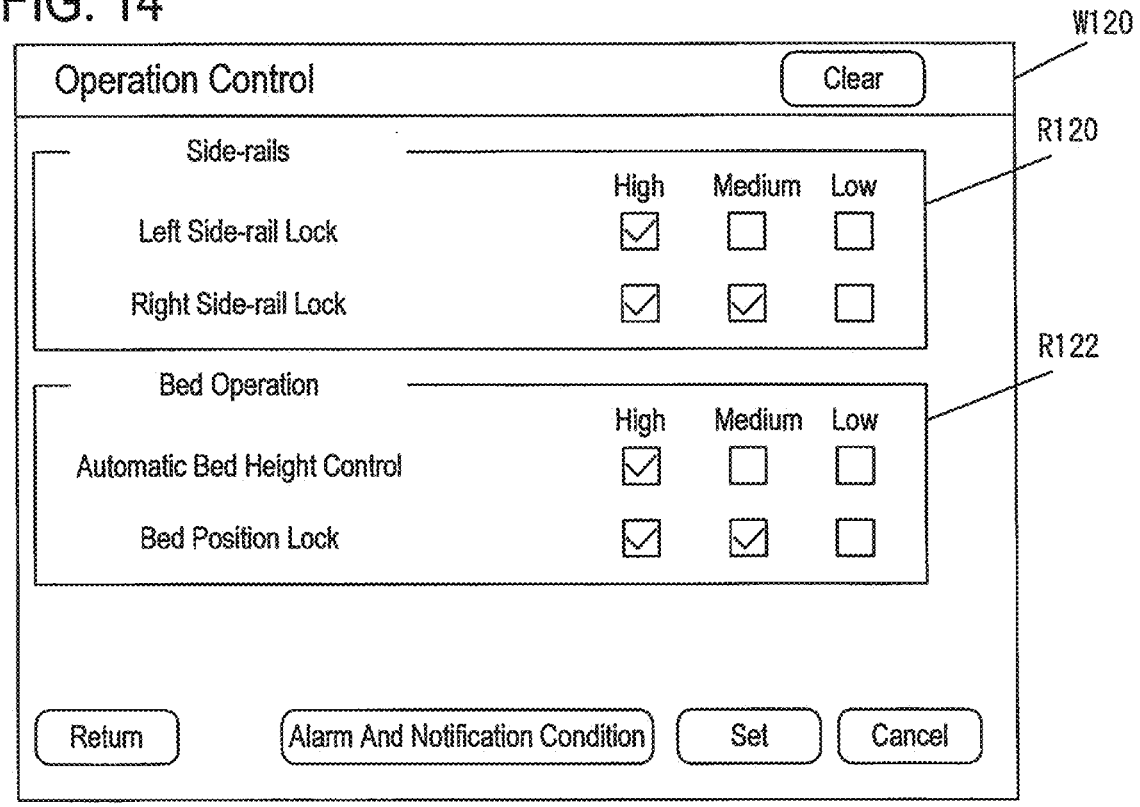
FIG. 14 shows one example of the display screen of the system in the first embodiment.

In FIG. 13, when a button B110 is selected, the display transitions to a display screen W120 shown in FIG. 14. The display screen W120 in FIG. 14 is a setting screen for setting operation control. Here, this screen includes an area R120 for operation control of side-rails and an area R122 for bed operation control.

That is, the display screen W120 is to designate the settings of operation control of various devices and the arrangement of the devices and the like. That is, which device should be controlled is designated depending on the priority. For example, in control of side-rail lock, both the left and right side-rails are locked for a patient whose priority is determined to be "high". In contrast, for a patient whose priority is determined to be "medium", only the right side-rail is locked.

Thus, the details of the conditions for alarms and notices and the operation control can be designated for each individual patient. Note that settings of operations can be done, as a default, for the whole or for each group.

Figure 15:
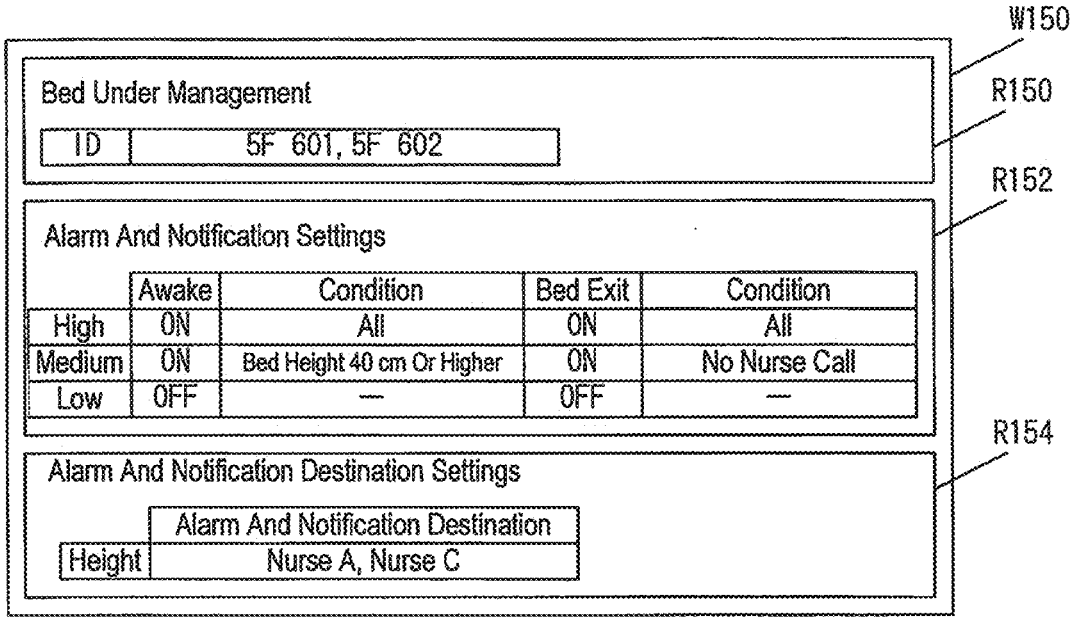
FIG. 15 shows one example of the display screen of the system in the first embodiment.
Figure 16:
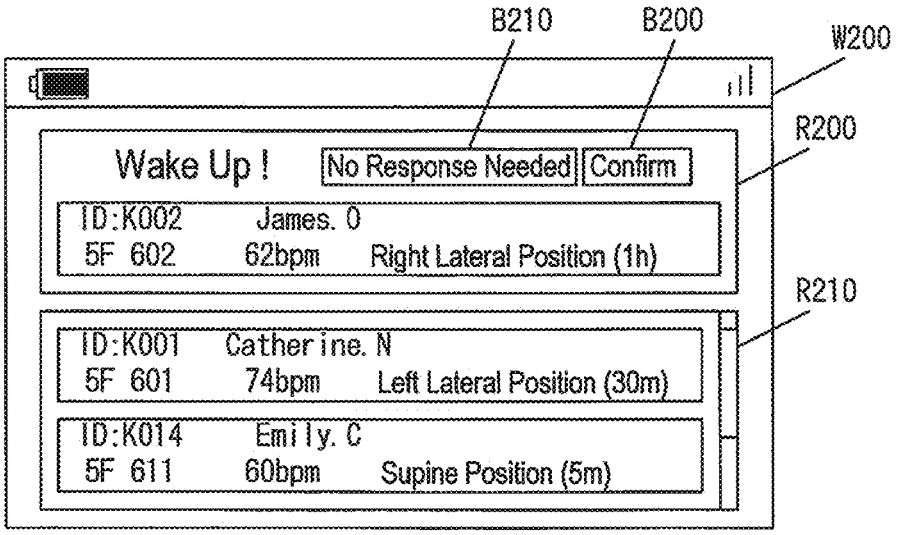
FIG. 16 shows one example of the display screen of a mobile terminal in the first embodiment.

FIG. 15 shows a display screen W150 for setting conditions for alarms and notices according to the priority for every group. For example, the display screen W150 includes an area R150 for allowing designation of beds to be managed in each group, an area R152 for setting common conditions for alarms and notices, and an area R154 for allowing settings of alarms and notices destinations.

The setting in the area R152 allows to set whether or not the patient status notifier 108 activates alarms and provides notices and the conditions for the alarms and notices for each level of priority. In the case of FIG. 15, for a patient whose priority is determined to be "high", the patient status notifier 108 actives alarms and provides notices in response to all the events including a first event where the patient awakens and a second event where the patient gets out of the bed.

In the case of a patient whose priority is determined to be "medium", the patient status notifier 108 activates alarms and provides notices if the patient awakens when "the bed height is 40 cm" or more. The patient status notifier 108 activates alarms and provides notices if the patient gets out of the bed "without pressing a nurse call".

Also, the notification destination setting allows to set alarms and notices destinations in accordance with the patient and priority. The patient status notifier 108 has information on the destinations, and provides notices to the destinations set in the area R120. In this case, only destinations are designated, but, for example, the mode of notification may also be set together.

A display screen W200 of the mobile terminal 30 in FIG. 16 displays a list of patients whom the terminal operator (e.g., a nurse) is in charge of, in an area R210. The patient list may be either displayed or may be usually retracted and displayed as necessary. Also, the list is not necessarily displayed.

Regarding to patient information, various kinds of information may be displayed together. For example, in addition to the patient ID, name and information on the hospital room, the sleeping posture of the patient and biological information (e.g., heart rate, respiratory rate, etc.) may be displayed. The state of the patient including information on whether the patient is in or out of bed, may also be displayed.

Upon receiving the alarms and notices from the server 10, the alarm processor 302 performs the alarm process. That is, in the area R200, the alarms and notices that the patient with the patient ID "K002" is awake is displayed. The alarm processor 302 may display the alarms and notices in a pop-up manner or may display the alarms and notices in a distinct display mode. Examples of the distinct display mode may include various methods such as enlarging the text size, color change, inverted display and flickering display.

Also, the area R200 may provide with a confirmation button B200 and a response unnecessary button B210. For example, alarm sound may turn off at the same time the confirmation button B200 is selected (touched). Further, the confirmation button may be displayed on a device near the bed so as to make the nurse or the care gives surely come to the bed and operate the device.

The confirmation button B200 and the response unnecessary button B210 are linked with the system 1 so that other nurses, medical workers and the care gives can share the information. For example, if a first care giver touches the confirmation button B200 in a first mobile terminal 30, the alarms and notices may be configured to disappear not only in the first mobile terminal but also in other mobile terminals (e.g. a second mobile terminal 30).

Further, if the response unnecessary button B210 is selected, the selected fact of the response unnecessary button is recorded in history information 132. The priority determiner 106, by reference to the history information 132, can change the priority level of the patient. That is, based on the history information 132, the priority determiner 106 may lower the priority level when there have been a number of response-unnecessary records, or may raise the priority level when there have been a number of confirmation records (responded events).

Suppose, for example, the priority is determined to be "high" in the priority determining process, the alarms and notices are provided every time the patient wakes up. However, if the patient does not get out of the bed even after the patient is awakening, the care giver selects "response unnecessary". When the care giver has selected "response unnecessary" a predetermined number of times, it is possible to execute such a process as to lower the priority level of the patient to "medium" or "low".

1.6 Advantages of this Embodiment

As described above, according to the present embodiment, the alarm process according to the priority of the patient can be executed. Further, the priority of the patient can be automatically set in conformity with the patient's state and personality and device states. Thereby, the alarm process can be implemented pertinently, so as to contribute to preventing the care givers and others from overlooking necessary alarm and notice events.

Further, by periodically executing the priority determining process, it is possible to always perform the alarm process in conformity with the conditions of the patient. For example, since the priority level of a patient can be determined according to the details of patient's condition such as medical condition and physical condition, it is possible to timely determine whether the alarms and notices are necessity or unnecessary in real time.

2. Second Embodiment

A second embodiment will be described. In the second embodiment, a notification from a patient by a nurse call and the limiting operation to a bed will be described.

Figure 17:
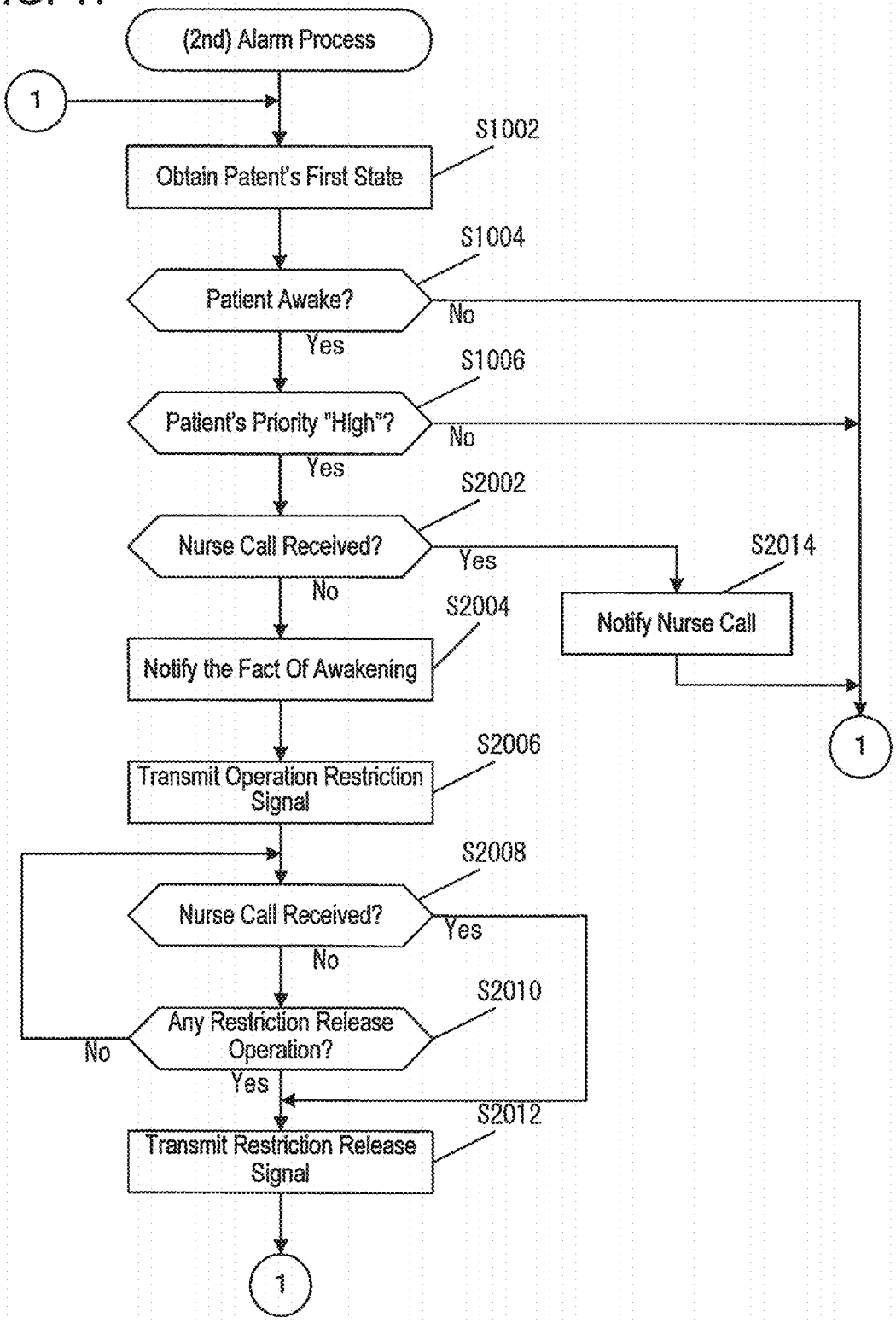
FIG. 17 is a flowchart illustrating a second alarm process in a second embodiment.

In the second embodiment, configurations and operations different from those of the first embodiment will be explained. In the second embodiment, the first alarm process shown in FIG. 11 of the first embodiment is replaced with the second alarm process in FIG. 17. The same procedures are denoted by the same reference numerals, and the description thereof is omitted.

2.1 Processing Flow

When the obtained first state of the patient transits from the "sleeping" state to the "awake" state, the patient status notifier 108 determines whether or not the priority of the patient is "high" (steps S1002 to S1006). Then, when receiving a nurse call, that is, when the nurse call button is pressed by the patient, the patient status notifier 108 makes a notification based on the nurse call (Step S2002; Yes→Step S2014). That is, the patient status notifier 108 notifies the nurse call, but does not perform any particular process based on the priority and the like.

In the present embodiment, if a nurse call is received at Step S2002, the server 10 gives a notification of the nurse call to the mobile terminal 30 when a nurse call is received regardless of the priority of the patient.

On the other hand, if a patient of high priority awaken while the nurse call button is not pressed (no nurse call signal is received) (Step S2002; No), the patient status notifier 108 provides notices of the fact the patient is awakening (Step S2004). Specifically, the patient status notifier 108 transmits the alarms and notices to the mobile terminal 30 through the communication unit 150. In the mobile terminal 30, the alarm processor 302 executes the alarm process based on the alarms and notices received from the server 10.

Further, the patient status notifier 108, as it transmits the alarms and notices, transmits an operation restriction signal to the drive controller 222 of the bed 22 (Step S2006). Thereby, the operation of the bed 22 is restricted.

Here, the operations to be limited may be determined previously or may be transmitted together with the restriction signal. Various operations can be considered as the operations restricted in the bed 22, but example of restricted operations are as follows:

(1) The drive controller 222 stops the operation of the lifting mechanism of the bed 22. For example, the height of the bed becomes unable to be changed.

(2) The drive controller 222 can control to lock the side-rails of the bed 22. By restricting the movement of the side-rails, it is possible to prevent the user from getting out of the bed selfishly. Here, the drive controller 222 can control the locking of the side-rails detailedly. For example, it is possible to control the locking of the side-rails on the right side and the left side, or control the locking of the side-rails on the head side and the foot side. That is, the drive controller 222 controls movement of each 4 side-rails independently. The control of locking of these side-rails may be performed as a whole, or may be selectively performed as necessary.

(3) The drive controller 222 can control to lock the caster mechanism. For example, a device (bed, side table, transfer machine, wheelchair, etc.) having a caster mechanism becomes unable to be moved freely, by locking the caster mechanism.

Here, the limiting operation of the bed 22 described above is cancelled and released by transmitting a restriction release signal to the drive controller 222 (Step S2012) when a nurse call button is pressed (nurse call signal is received) (Step S2008; Yes) or when a restriction release operation is performed (Step S2010; Yes).

The above description of the embodiment was described by giving an example where an operation restriction signal is transmitted from the server 10 to the bed 22. An operation signal may be transmitted together with the operation restriction signal. For example, when the height of the bed 22 is equal to or greater than a predetermined height, an operation signal for lowering the bed to a specified height is transmitted. Also, for example, in a case where back-raising and/or knee-raising has been performed, a signal for performing an operation of flattening the bed or conversely performing a back-raising operation also may be transmitted.

2.2 Sequence Diagram

Figure 18:
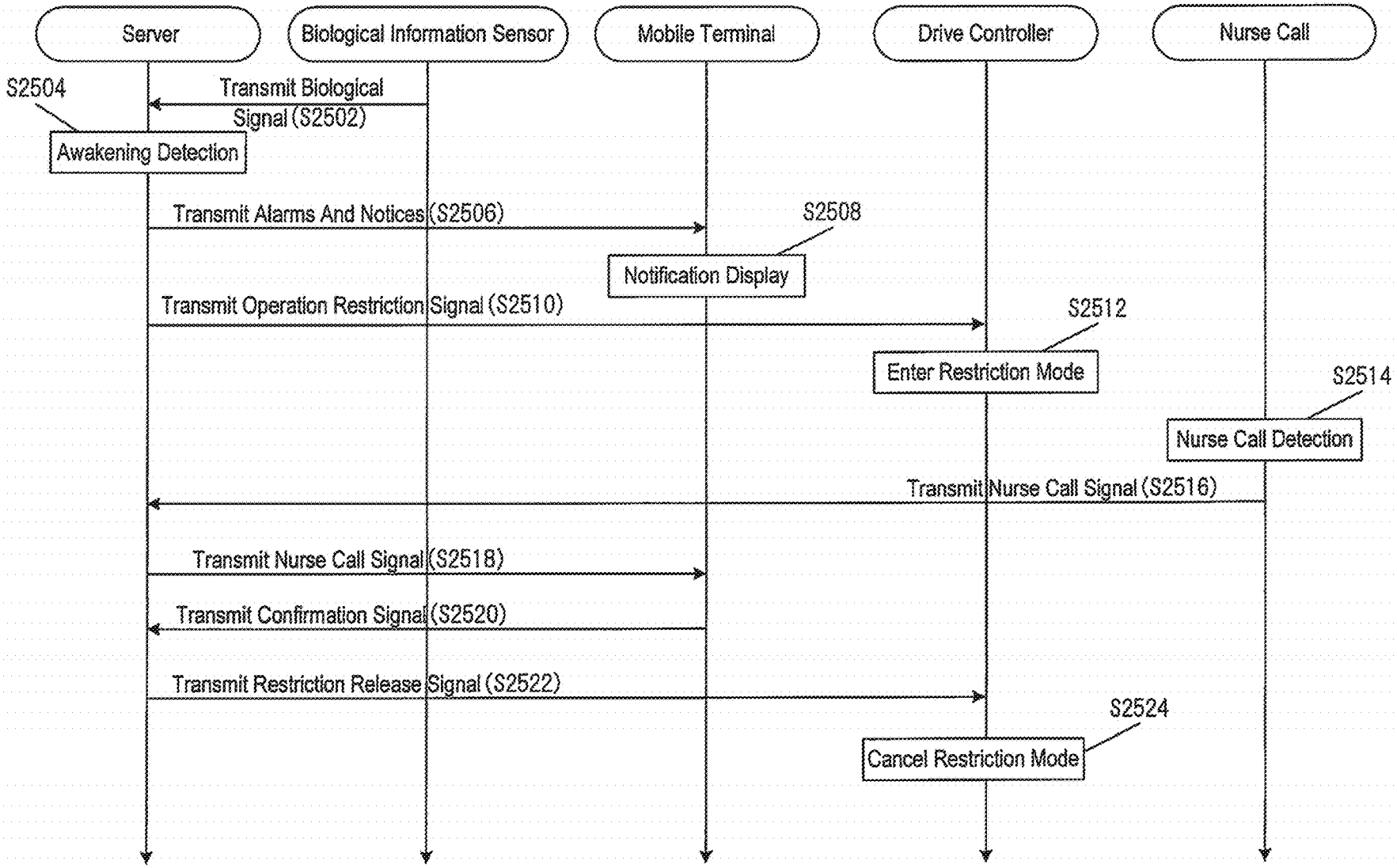
FIG. 18 is a sequence diagram illustrating the flow of processing in the second embodiment.

Next, the cooperation of the individual devices in the present embodiment will be described using a sequence diagram of FIG. 18.

First, biological signals obtained by the biological information sensor 242 are transmitted to the server 10 (S2502). The server 10 (patient information obtainer 104) detects whether the patient awaken based on the received biological signals (S2504). If the priority level of the patient that has been detected is high, the server 10 (the patient status notifier 108) transmits alarms and notices to the mobile terminal 30 (S 2506). The mobile terminal 30 (the alarm processor 302) activates alarms and provides notices on the display unit 340 (S2508). The alarm processor 302 may make notices (e.g., output an alarm sound etc.).

The server 10 (the patient status notifier 108) transmits an operation restriction signal to the bed 22 (drive controller 222) (S2510). The bed 22 (drive controller 222) shifts to the restriction mode in accordance with the received operation restriction signal (S2512). When the bed 22 shifts to the restricted mode, the patient can not freely operate the movement of the bed. For example, as the side-rails are locked, the patient can not get out of the bed.

Here, the side-rails are provided along the longitudinal direction of the bed. In the present embodiment, the drive controller 222 can control to raise and lower the side-rails. The patient can not get out of the bed if the side-rails are located in "up" state. The side-rails can be controlled by the drive controller 222. For example, the side-rails can be raised or lowered electrically, and the locking mechanism can be turned on or turn off. That is, when the operation is restricted, the side-rails are kept raised, so that it is possible to prevent the patient from getting out of the bed selfishly.

Here, when it is detected that the nurse call button 26 is pressed by the patient (S2514), a nurse call signal is transmitted from the nurse call 26 to the server 10. The server 10 transmits a nurse call signal indicating that the nurse call button has been pressed to the mobile terminal 30 (S2518). The mobile terminal 30 displays on the display unit 340 the fact that the nurse call button has been pressed, and the operator (e.g., a nurse or a staff member) of the mobile terminal 30 can recognize that the nurse call button has been pressed.

Apart from the signal transmitted when the nurse call button is pressed, a confirmation signal may be transmitted from the mobile terminal 30 to the server 10 (S2520). The confirmation signal is transmitted by a nurse or a care giver using the mobile terminal 30 when the nurse or the care giver selects a confirmation button together with performing a predetermined confirmation operation.

Upon receiving the nurse call signal or the confirmation signal, the server 10 transmits a restriction release signal to the bed 22 (drive controller 222) (S2522). Upon receiving the restriction release signal, the bed 22 (drive controller 222) cancels the restriction mode (S2524). Thereby, the patient can freely operate the devices on the bed 22.

In the process described above, the operation restriction on the bed 22 is canceled and released when a notification is received by the pressing of the nurse call button. In this case, the timing when the restriction mode is released can be variously changed.

For example, the timing when the restriction mode is released can be variously considered as follows:

(1) When the nurse call button is pressed, the bed 22 will not shift to the operation restriction mode.

(2) When the nurse call button is not pressed, the bed 22 enters into the operation restriction mode. If the nurse call button is pressed, the operation restriction mode of the bed 22 is immediately canceled and released.

(3) When the nurse call button is not pressed, the bed 22 shifts to the operation restriction mode. If the nurse call button is pressed, the operation restriction mode of the bed 22 is canceled and released after passing predetermined time from a timing when the nurse call button is pressed.

(4) When the nurse call button is not pressed, the bed 22 enters to the operation restriction mode. If the nurse call button is pressed, the restriction mode is canceled and released by operating the terminal device beside the bed.

2.3 Advantages of this Embodiment

As described above, according to the present embodiment, when a patient with high priority awaken, it is possible to not only activates alarms and provides notices to the mobile terminal 30, but also restrict the operation of the bed 22.

In addition, since the restriction of operation of the bed device 22 is adapted so as not to be implemented when the patient presses the nurse call button, it is possible to urge the patient to positively press the nurse call button.

3. Third Embodiment

In the first embodiment and the second embodiment, the patient status notifier 108 determines whether or not the alarms and notices are required and whether or not to make the bed 22 shift to the restriction mode, in accordance with the priority of the patient when the patient wakes up.

In the present embodiment, the process is performed when a prospect where patient gets out of the bed is detected after the patient is awakening.

For example, even if the patient is awakening, the patient does not necessarily always get out of the bed. The alarms and notices are activated and adapted when the prospect is detected from the action leading the patient to get out of the bed. Specifically, though it is determined at Step S1004 whether or not the patient is "awakening", it is also possible to determine whether or not "detection of the prospect the patient gets out of the bed".

Here, the detection of the prospect is to detect that the patient takes an action leading to getting out of the bed. As typical actions leading to getting out of the bed, the following can be considered.

(1) A case where the patient takes a sitting posture on the bed 22

(2) A case where the patient takes a sitting position at the side of the bed 22

(3) A case where the patient lowers the height of the bed after the patient is awakening (4) A case where the patient performs a back-raising operation by a predetermined angle or more after the patient is awakening (5) A case where the patient presses the nurse button Such an action is assumed as a sign where the patient gets out of the bed and detected as the prospect. Then, when a prospect is detected, the alarms and notices are provided for a patient whose priority is high.

In addition, the patient status notifier 108 may change a timing related to the prospect, in accordance with the priority of the patient. For example, the patient' action to get out of the bed is considered as following stages of:

(1) awakening;

(2) taking a sitting posture on the bed 22; and (3) taking a sitting position at the side of the bed 22.

For example, the patient status notifier 108 activates alarms and provides notices at the first stage (1) for a patient whose priority is determined to be "high". The patient status notifier 108 activates alarms and provides notices at the second stage (2) for a patient whose priority level is "medium". The patient status notifier 108 activates alarms and provides notices at the third stage (3) for a patient whose priority level is "low".

In this way, the patient status notifier 108 may change the timing according to the priority.

Figure 19:
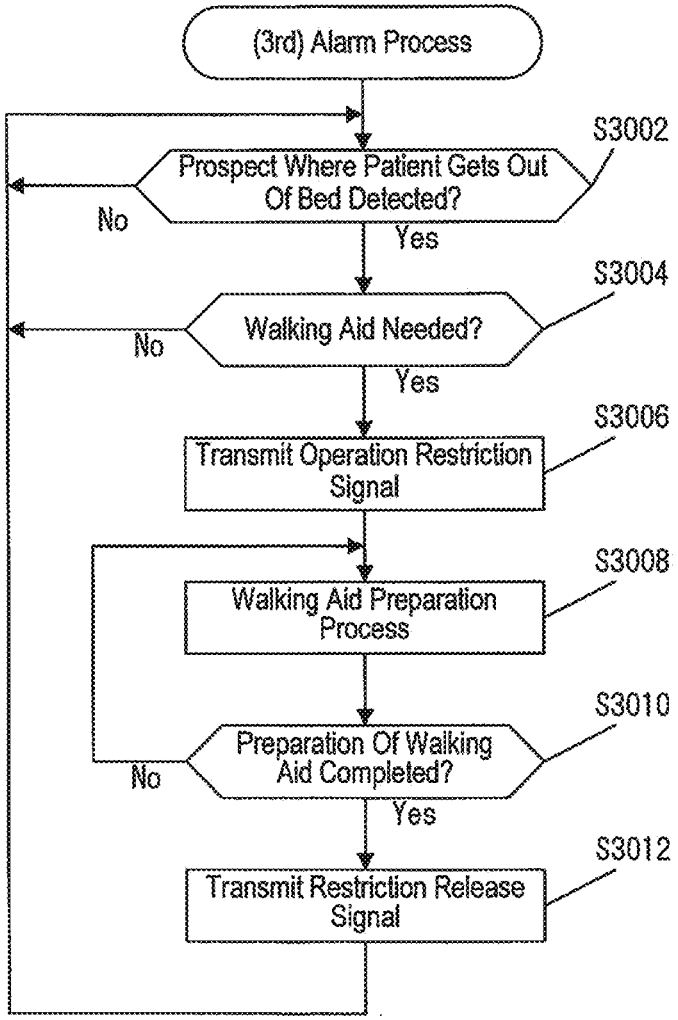
FIG. 19 is a flowchart illustrating a third alarm process in a third embodiment.

Further, the patient status notifier 108 may recommend assistance equipment, in addition to providing notices. The alarm process (third alarm process) in this case will be described by reference to the operation flow in FIG. 19.

Upon the controller 100 detects the prospect where the patient gets out of the bed (Step S3002; Yes), the controller 100 determines whether or not a walking aid is necessary for the patient (Step S3004). Here, in order to determine the patient's necessity of a walking aid, for example the patient's medical history, the medication information and the patient fall-risk assessment are referred to from the electronic medical record server to determine whether or not the patient needs a walking aid.

In the present embodiment, the controller 100 determines the necessity of a walking aid, but other necessary device like other assisting devices (e.g. a wand, a wheelchair and a stretcher) may be recommended and determined as appropriate.

Then, when a walking aid is necessary for the patient (Step S3004; Yes), the patient status notifier 108 transmits an operation restriction signal to the bed 22 (the drive controller 222, etc.) (Step S3006). As a result, the bed 22 transitions to the operation restriction mode. In the present embodiment, for example, the side-rails are locked.

Subsequently, the controller 100 executes a walking aid preparation process (Step S3008). Here, the walking aid preparation process is to order a necessary walking aid to, for example an equipment server which is not shown.

Also, various methods of determining a necessary walking aid can be considered. There is a case in which an order of a walking aid is placed simply or in some cases an order of a walking aid that matches the physique of the patient or staff is placed.

To describe a specific example, the type of the walking aid may be determined based on the weight difference between the patient and the staff. That is, if the difference in body weight is greater than a threshold, a larger walking aid is needed. Then, the side-rails are locked until the walking aid is prepared and provided near the bed. Additionally, an assist bar may come out as soon as the side-rails are unlocked and lowered.

If the walking aid is not prepared and provided near the bed (when the walking aid is not in a predetermined position), the side-rail will not go down, and if the side-rail is tried to be forcibly lowered, a voice sound is output and transmitted to the patient and the staff. Further, if the walking aid can be automatically transported, the side-rail remains locked until the walking aid reaches to the predetermined position.

Then, when the walking aid has been prepared (Step S3010; Yes→Step S3012), a restriction release signal is sent from the server 10 (patient status notifier 108) to the bed 22.

4. Fourth Embodiment

Figure 20:
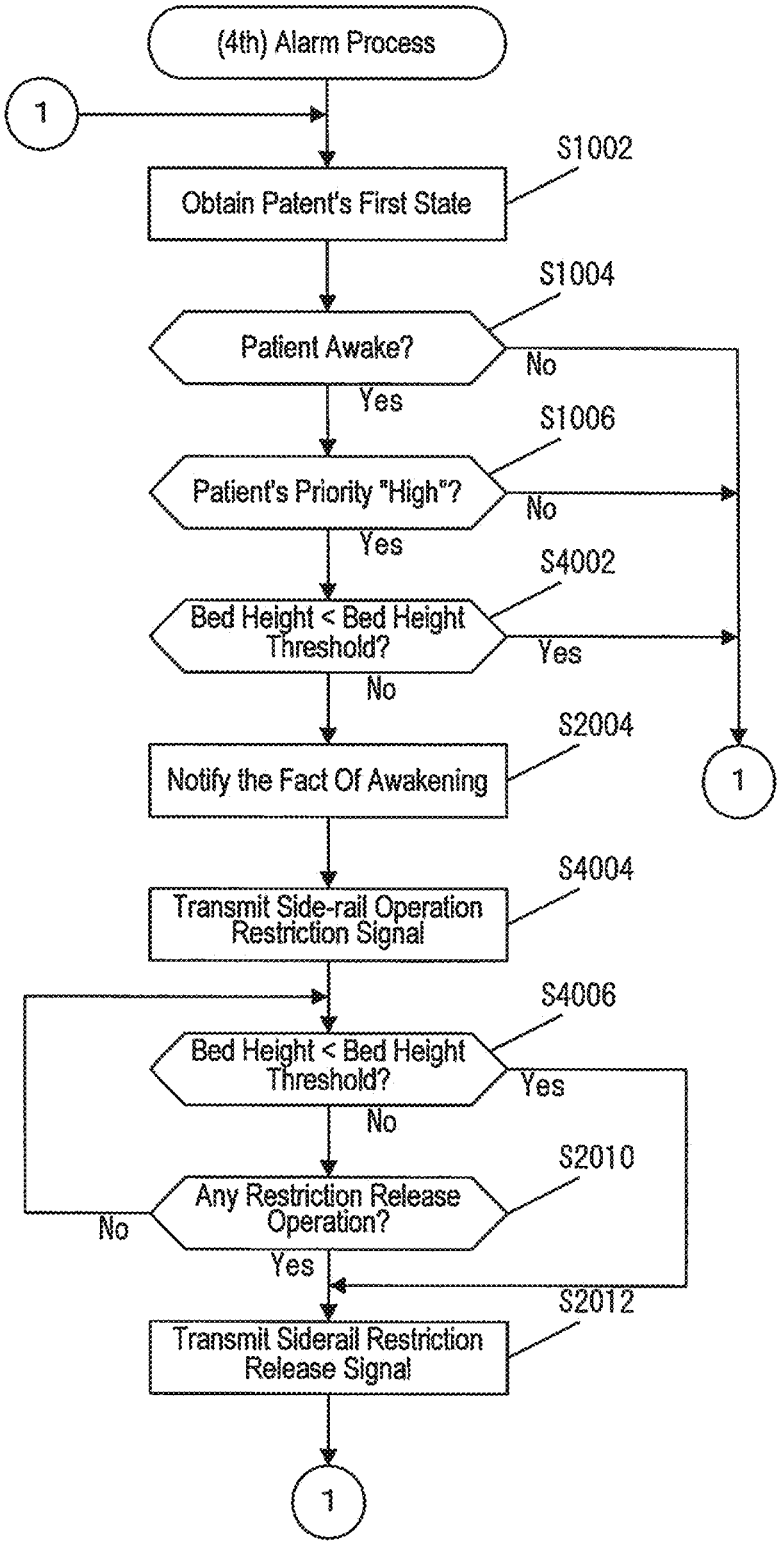
FIG. 20 is a flowchart illustrating a fourth alarm process in a fourth embodiment.

A fourth embodiment will be described. In this fourth embodiment, when the patient status notifier 108 is configured to control the drive controller 222 to limit the movement of the bed 22, a necessary function is restricted. The present embodiment described herein is a case where the operation flow of FIG. 17 of the second embodiment is replaced by the operation flow of FIG. 20. The same processes as those of the second embodiment are denoted by the same reference numerals, and the description thereof is omitted.

When the first state indicates the patient is awakening, and the priority of the patient is "high", the controller 100 determines whether or not the bed height is less than a bed height threshold (Step S4002). If the bed height is less than the bed height threshold, no particular restriction is applied.

When the bed height is equal to or greater than the bed height threshold (Step S4002; Yes), the patient status notifier 108 notifies the fact the patient is awakening (Step S2004). At this time, a side-rail operation restriction signal is transmitted to the drive controller 222 of the bed 22 (Step S4004).

Then, when the bed height is less than the bed height threshold (Step S4006; Yes) or when there is a restriction release operation (Step S2010; Yes), the patient status notifier 108 transmits a side-rail restriction release signal to the drive controller 222 of the bed 22.

According to the fourth embodiment, the side-rails can be locked (so as not to be lowered) until the bed height downs to a safe level. Thus, it is possible to restrain the patient from getting out of the bed while the height of the bed is high, hence prevent patient from falling off the bed.

5. Variational Example

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

Although the system 1 described above is one that used in a hospital or a facility, the system may be used for home care and the like, for example. In this case, the patient may be only one care-receiver, or the system may be used by only limited people such as care staff and family members.

In this case, only the information on the care-receiver may be displayed for the users who are authenticated by the authentication unit 102. Further, a typical smartphone or the like can be used as the mobile terminal 30. In this case, notification is provided through an application installed on the smartphone, by e-mails or on the SNS.

Further, in the above-described embodiments, processing is executed by the server 10, but may be realized by installing application software in a terminal device (e.g., as a smartphone, tablet and computer). Alternatively, processing may be performed on an external server and the processed result may be returned to the terminal device.

In addition, in the embodiments, the program operated on each device is a program (a program for causing a computer to function) for controlling the CPU or the like so as to realize the function of the above-described embodiments. Information handled by these devices is temporarily stored in a temporary storage device (for example, RAM) at the time of processing, and thereafter is stored in storage devices such as ROMs, HDDs and SSDs, read out, modified and written in by the CPU as necessary.

To put the product on the market, the program may be stored on a removable recording medium, or may be transferred to a server computer connected to a network such as the Internet or the like. In this case, it goes without saying that the storage device of the server computer is also included in the present invention.

What is claimed is:

1. A terminal device comprising:

a communication unit configured to communicate with an outside device, the communication unit being capable of receiving a user information;

a display configured to display an alarm corresponding to a first user assigned to a first priority is at or greater than a threshold priority and configured not to display an alarm corresponding to a first user assigned to a first priority is less than a threshold priority if the first user is awake or gets out of a bed based on the user information.

2. The terminal device according to claim 1, wherein the display is configured to display a first button indicating no response is needed to the alarm and a second button indicating a response is needed if the alarm is activated.

3. The terminal device according to claim 2, wherein the first priority is changed to a second priority based on a number of times the first button is selected.

4. The terminal device according to claim 1, wherein the first priority is assigned based on a quality of sleep of the first user.

5. The terminal device according to claim 1, wherein the first priority is assigned based on at least one of (i) a difference between a recent sleeping time and an average sleeping time during a plurality of days and a first threshold and (ii) a number of times the first user got out of the bed during bedtime and a second threshold.

6. The terminal device according to claim 1, wherein the first priority is assigned based on a-number of times the first user got out of the bed during bedtime without notification calls and a first threshold.

7. The terminal device according to claim 1, wherein the first priority is assigned based on a number of times a height of the bed exceeds a stored height and a first threshold.

8. The terminal device according to claim 5, wherein the first priority is assigned based on a number of times the first user got out of the bed during bedtime without notification calls and a third threshold, and the first priority is assigned based on a number of times a height of the bed exceeds a stored height and a fourth threshold.

9. The terminal device according to claim 1, wherein the display does not display the alarm even when the first user is awaken or gets out of the bed and the first priority is at or greater than a threshold priority, and if the first user push a notification call.

10. The terminal device according to claim 1, wherein the first priority is stored in a table, the table including priorities associated with a plurality of users, respectively, the priorities representing possibilities of the plurality of users falling off the bed, respectively.

11. A management system comprising:

a communication unit configured to communicate with a terminal device and a bed device;

a controller configured to, assign a first user to a first priority, activate an alarm to the terminal device if the first user is awake and the first priority is at or greater than a threshold priority and not activate the alarm if the first user is awake or gets out of the bed and the first priority is less than a threshold priority;

the terminal device including a display configured to display the alarm; and the bed device configured to restrict a first operation if the bed device receive an information related to the alarm.

12. The management system according to claim 11, wherein the first operation is one of the operations, the operations including:

an operation of a height of the bed device is changed, an operation of a side rail of the bed device moves, and an operation of a caster moves.

13. The management system according to claim 11, wherein the bed device does not restrict a first operation even when the first user is awaken or gets out of the bed and the first priority is at or greater than a threshold priority, and if the first user push a notification call.

14. The management system according to claim 11, wherein the bed device does not restrict a first operation even when the first user is awaken or gets out of the bed and the first priority is at or greater than a threshold priority, and if the first user push a notification call.

15. The terminal device according to claim 11, wherein the first priority is stored in a table, the table including priorities associated with a plurality of users, respectively, the priorities representing possibilities of the plurality of users falling off the bed, respectively.

* * * * *